US007942117B2

(12) United States Patent
Robinson

(10) Patent No.: US 7,942,117 B2
(45) Date of Patent: May 17, 2011

(54) ENGINE

(76) Inventor: Thomas C. Robinson, San Francisco, CA (US)

( * ) Notice: Subject to any disclaimer, the term of this patent is extended or adjusted under 35 U.S.C. 154(b) by 680 days.

(21) Appl. No.: 11/752,838

(22) Filed: May 23, 2007

(65) Prior Publication Data

US 2008/0006032 A1 Jan. 10, 2008

Related U.S. Application Data

(60) Provisional application No. 60/808,640, filed on May 27, 2006.

(51) Int. Cl.
*F02B 33/00* (2006.01)

(52) U.S. Cl. ..... 123/68; 60/598

(58) Field of Classification Search ..... 123/68, 123/39, 70 R, 563, 559.1, 559.2; 60/598, 60/599, 604, 606, 607, 622, 624
See application file for complete search history.

(56) References Cited

U.S. PATENT DOCUMENTS

| | | | | |
|---|---|---|---|---|
| 3,618,574 | A | 11/1971 | Miller | |
| 3,998,599 | A | 12/1976 | Fedor | |
| 4,333,424 | A * | 6/1982 | McFee | 123/39 |
| 4,476,821 | A | 10/1984 | Robinson et al. | |
| 5,572,962 | A | 11/1996 | Riley | |
| 5,771,868 | A | 6/1998 | Khair | |
| 6,209,495 | B1 | 4/2001 | Warren | |
| 6,543,225 | B2 | 4/2003 | Scuderi | |
| 6,609,371 | B2 | 8/2003 | Scuderi | |
| 6,722,127 | B2 | 4/2004 | Scuderi et al. | |
| 6,880,502 | B2 | 4/2005 | Scuderi | |
| 6,951,211 | B2 | 10/2005 | Bryant | |
| 6,952,923 | B2 | 10/2005 | Branyon et al. | |
| 7,017,536 | B2 | 3/2006 | Scuderi | |
| 7,353,786 | B2 | 4/2008 | Scuderi et al. | |
| 7,571,699 | B2 | 8/2009 | Forner, Sr. et al. | |
| 7,588,001 | B2 | 9/2009 | Branyon | |
| 2004/0060524 | A1 | 4/2004 | Hwang et al. | |

FOREIGN PATENT DOCUMENTS

| | | |
|---|---|---|
| CN | 2071713 U | 2/1991 |
| CN | 1173214 | 2/1998 |
| CN | 1497157 | 4/2004 |
| WO | WO03/008785 | 1/2003 |
| WO | WO03/040530 | 5/2003 |
| WO | WO2004/113700 | 12/2004 |
| WO | WO2005/010329 | 2/2005 |
| WO | WO2007/081445 | 7/2007 |
| WO | WO2007/111839 | 10/2007 |

* cited by examiner

*Primary Examiner* — Michael Cuff
*Assistant Examiner* — Hung Q Nguyen
(74) *Attorney, Agent, or Firm* — Jill L. Robinson

(57) ABSTRACT

An engine includes two or more serially connected air compressors coupled via a crankshaft to an expander piston and cylinder combination. An intercooler device is placed between the air compressors. Compressed air from the compressors flows through a heat exchanger where it is heated by the expander exhaust gas prior to its introduction into the expander cylinder by way of an inlet valve. Fuel is mixed with the compressed air near the inlet valve in an amount suitable to allow for combustion. An auxiliary compressor allows for the selective introduction of additional compressed air into the heat exchanger

20 Claims, 18 Drawing Sheets

ENGINE

CROSS REFERENCE TO RELATED APPLICATIONS

This invention relates to an improvements to an engine first described in U.S. Pat. No. 4,476,821 (the "'821 patent"), which is incorporated by reference herein and is a continuation-in-part of provisional patent application 60/808,640, which is incorporated by reference herein.

BACKGROUND OF THE INVENTION

The '821 patent described an engine that included an air compressor piston and cylinder combination coupled via a crankshaft to a power piston and power cylinder combination. Compressed air from the compressor cylinder flowed through a heat exchanger prior to its introduction into the power cylinder by way of an inlet valve. During the power piston downstroke compressed air flowed into the power cylinder. Fuel was mixed with the compressed air between the inlet valve and the piston in an amount suitable to allow for combustion. During the in-stroke of the power piston, the inlet valve was closed and the exhaust valve was opened to discharge the products of the combustion from the power cylinder through the heat exchanger to release the exhaust heat to the compressed air.

BRIEF SUMMARY OF THE INVENTION

The current invention comprises a series of improvements and refinements to the engine concept described in the '821 which result in improved engine performance and efficiency.

The modular engine operates with a modified Brayton cycle, which is a thermodynamic cycle in which air compression occurs in one device; fuel is added to the compressed air and combustion occurs; and the combustion gases are expanded in a separate expander device to produce power. The expander power output is partially used to operate the compressor. The peak compressor, combustion, and expander pressures are essentially the same.

In particular, the current invention contemplates the use of more than one compressor stage with provision for cooling the compressor parts and the optional use of an intercooler between the compressor stages to reduce compressor power input. Additional refinements allow for integration of those components of the system with intermittent flow and those that require a more steady state flow.

The objectives of this modular engine include providing substantially higher thermal efficiency, resulting in lower fuel consumption, than current gasoline (spark ignition) or diesel (compression ignition) engines of the same power output. The modified Brayton cycle provides thermodynamic characteristics and advantages that permit the modular engine to achieve these high efficiencies.

Other objectives compared with current engines are reduced pollutant and carbon dioxide emissions; ability to use all feasible liquid or gaseous fuels; reduced or similar size, weight, life and reliability; and similar manufacturability and cost.

Thermodynamic analyses of this modified Brayton cycle using a piston expander module and at least one piston compressor stage but at least two stages of compression reveal some alternative modes of operation that achieve high ideal (loss-free) efficiencies and high actual (with calculatable losses) efficiencies.

In its simplest form, the modular engine does not use a recuperator and may or may not use compressor intercoolers. It operates at high compressor outlet pressures, perhaps over a 600 to 3000 psi range, similar to turbocharged or supercharged engines. Such an engine provides ideal thermal efficiencies of about 70% and estimated actual efficiencies of about 55%. This compares with about 25% to 30% actual efficiencies for current gasoline engines and about 35% to 40% for current diesel engines used in light vehicles. Operation at higher pressures results in decreasing efficiency benefits when either recuperator or intercooler are used However, use of a recuperator and at least one intercooler between the compressor stages yields performance advantages. It operates at moderate compressor outlet pressures, perhaps over a 300 to 1500 psi range. The ideal efficiency of this modular engine is about 80%, and the estimated actual efficiency is about 60%. The recuperator plus lower compressor outlet pressures result in somewhat higher weight and size per rated engine power, and somewhat higher cost and complexity, but achieve the lower fuel consumption and carbon dioxide emissions.

The current invention also contemplates various means for modifying the power output of the engine including specific alterations of valve timing and the use of an auxiliary compressor.

BRIEF DESCRIPTION OF THE SEVERAL VIEWS OF DRAWINGS

Figure 6A:
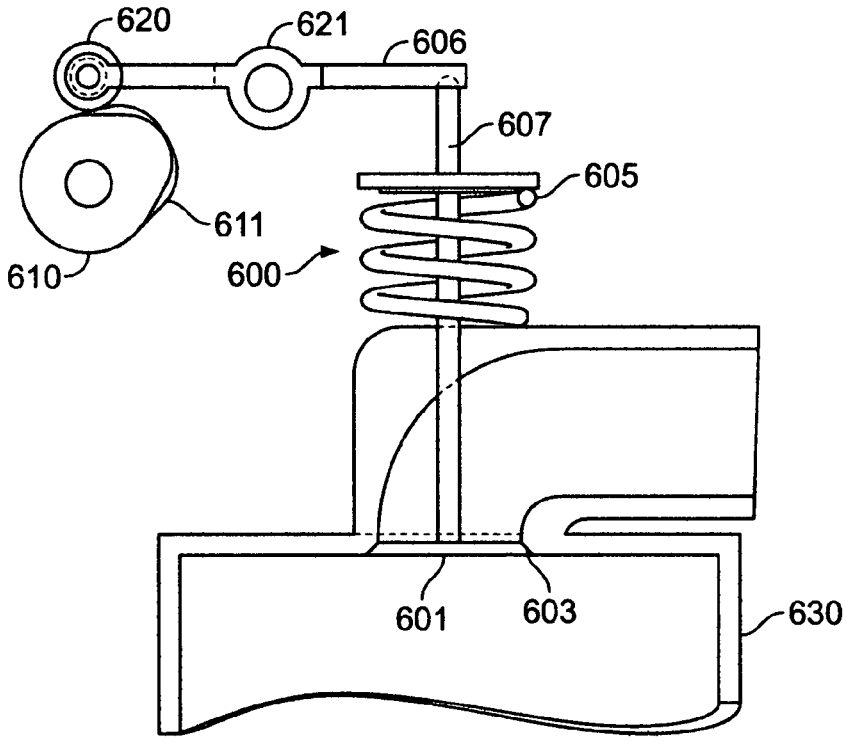
Figure 6B:
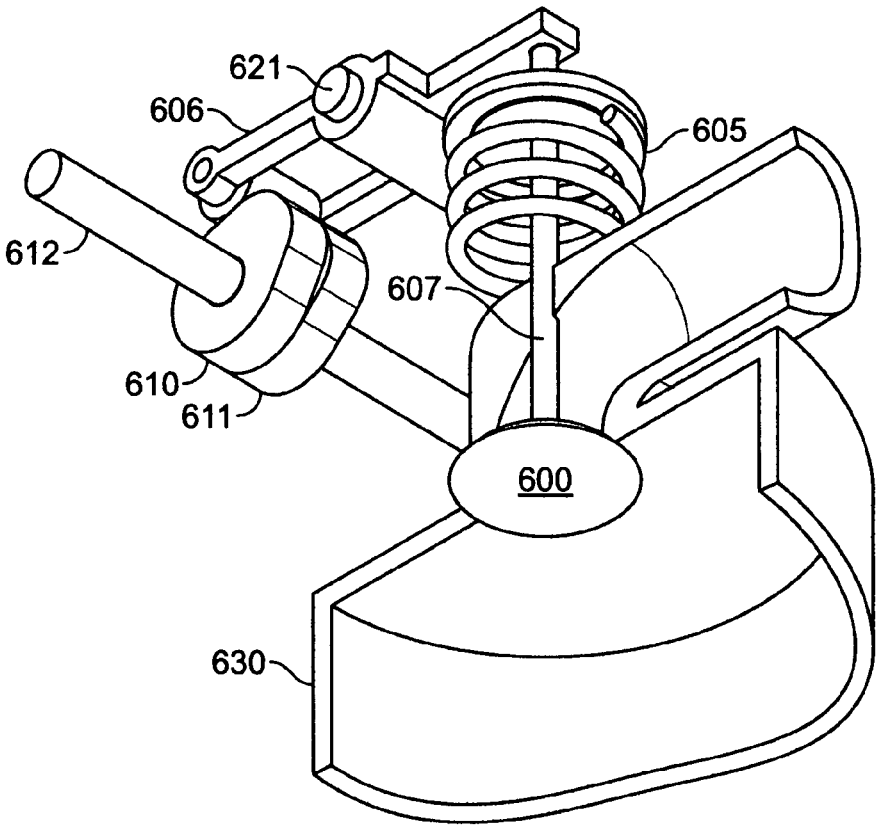
Figure 6C:
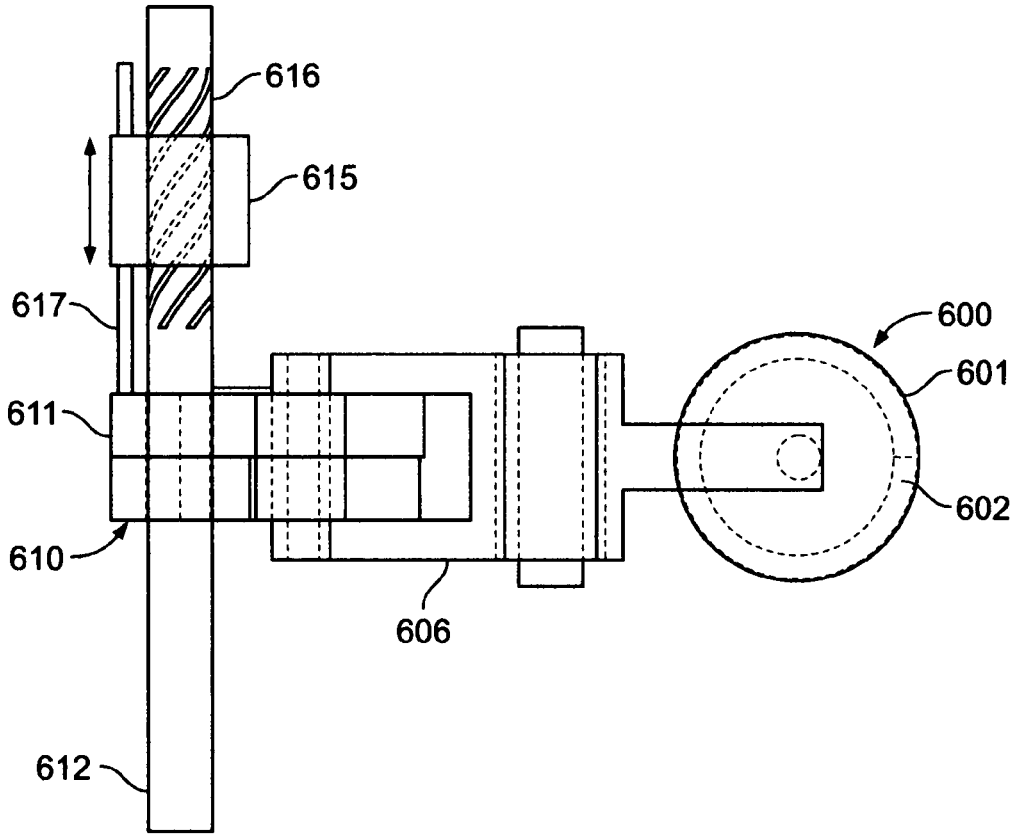

FIGS. 6A-C show a dual cam, variable valve timing design for operating valves in the system.

Figure 7:
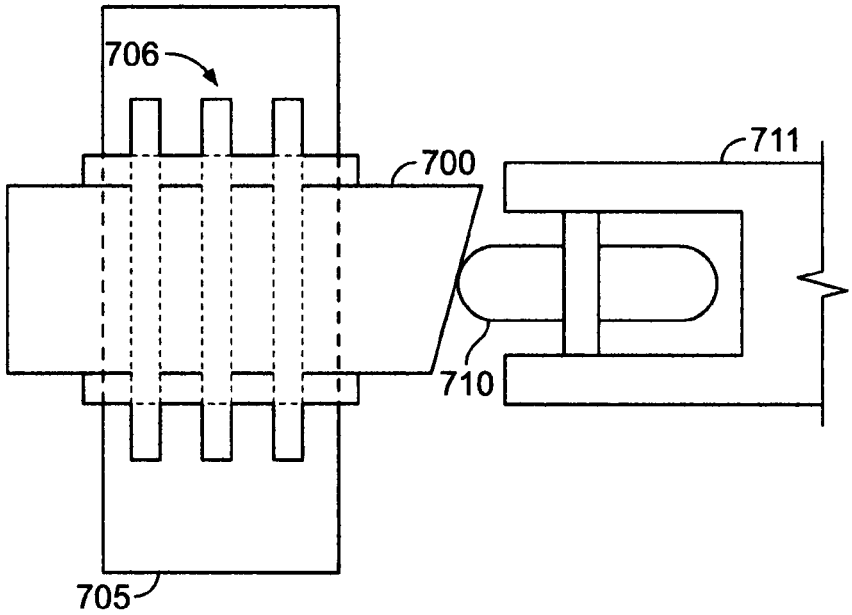

FIG. 7 shows a alternative three-dimensional cam, variable valve timing design for operating valves in the system.

Figure 8:
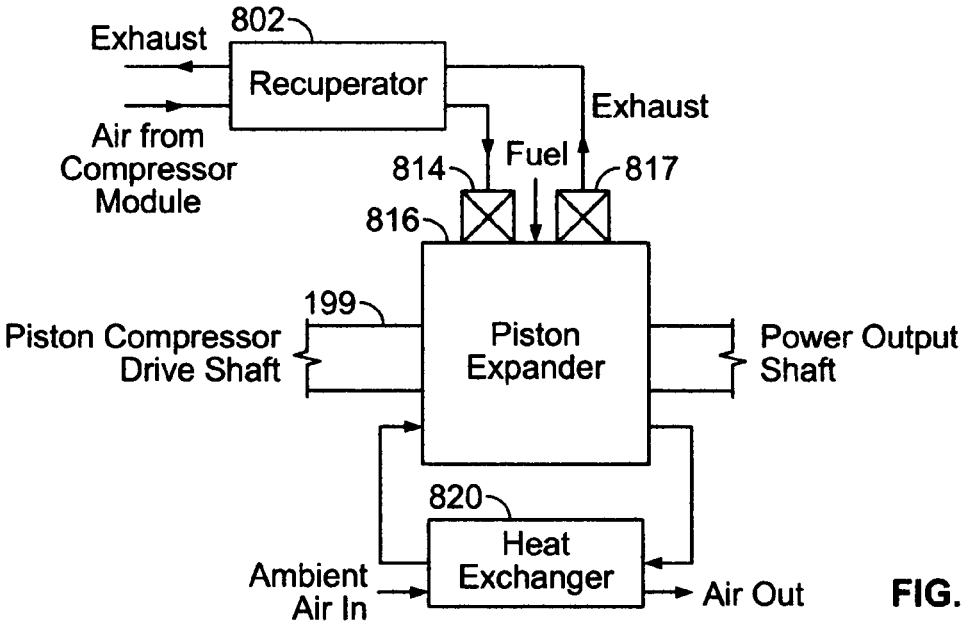

FIG. 8 shows a schematic representation of the expander module.

Figure 9A:
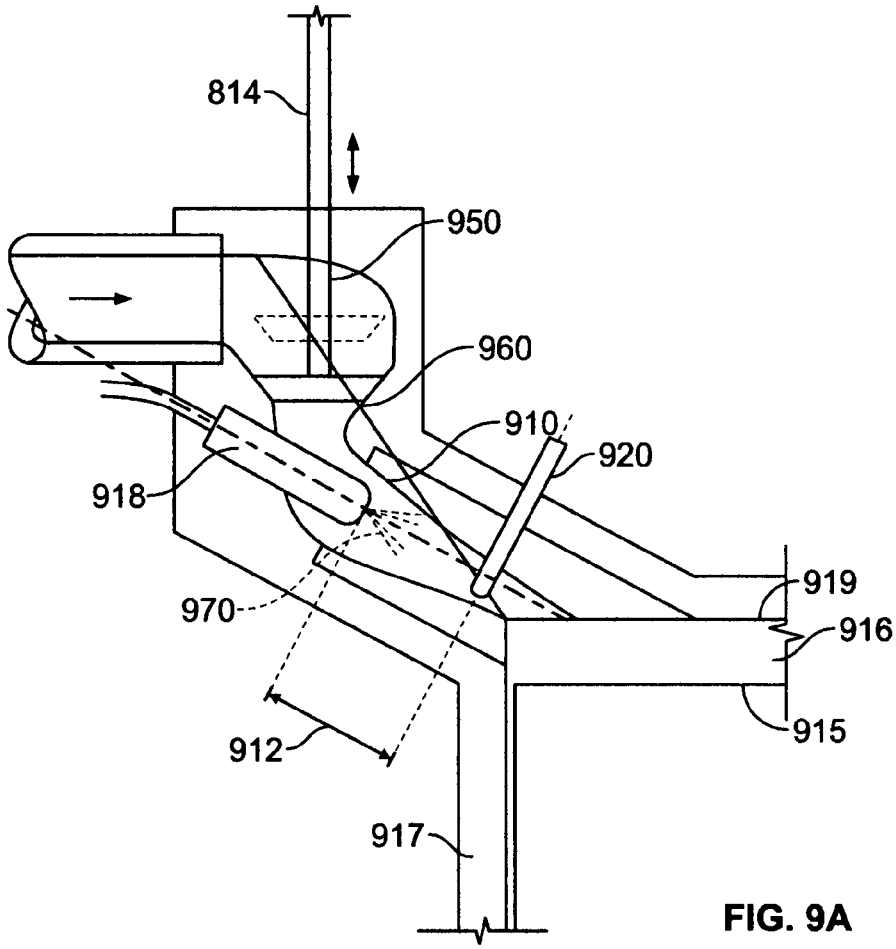
Figure 9B:
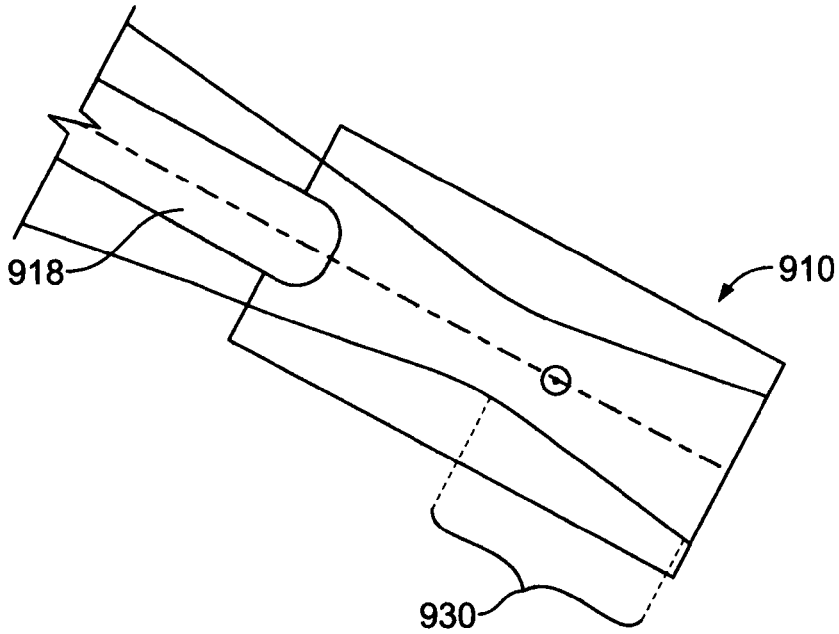

FIG. 9 A shows a detail of the inlet valve, duct and cylinder of the expander in which the operation is "push to close."

FIG. 9 B shows a detail of the duct.

Figure 10:
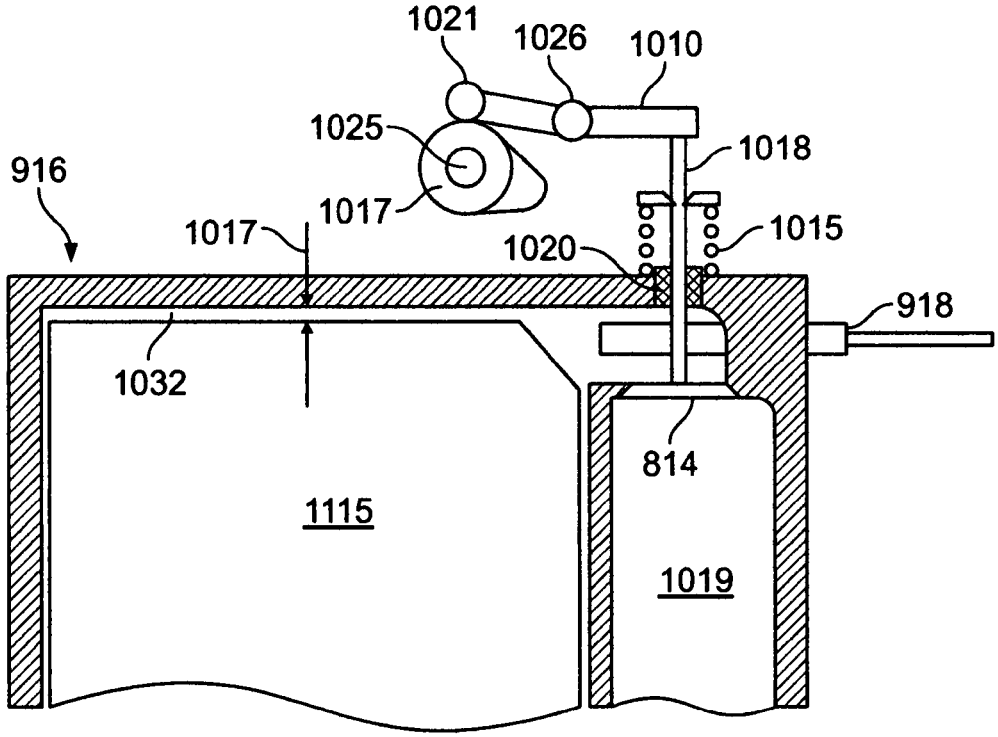
Figure 11B:
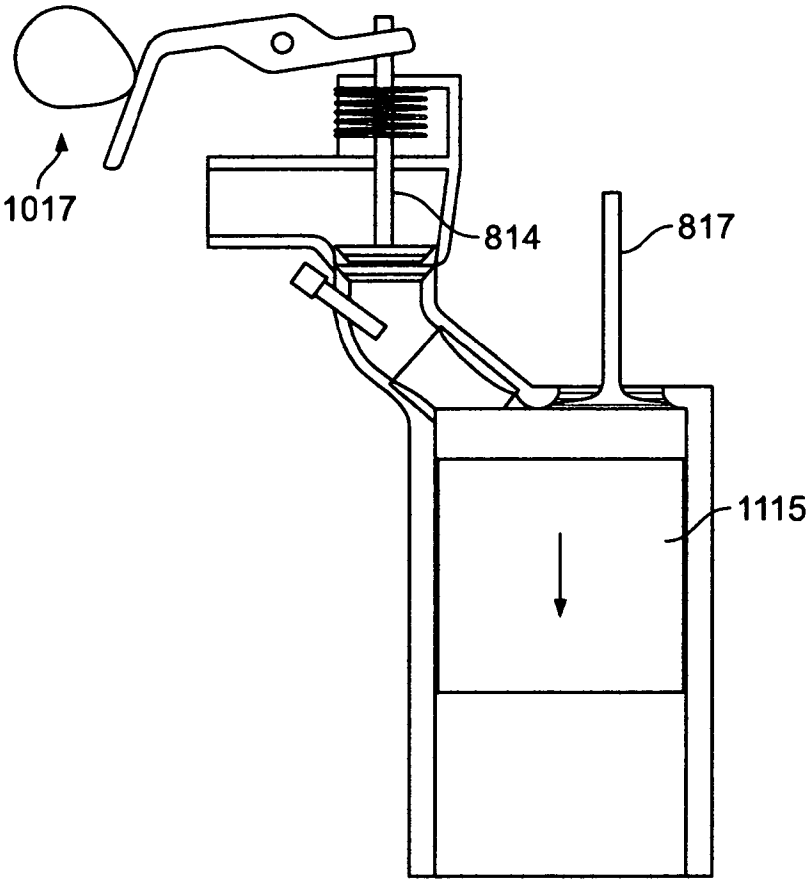
Figure 11A:
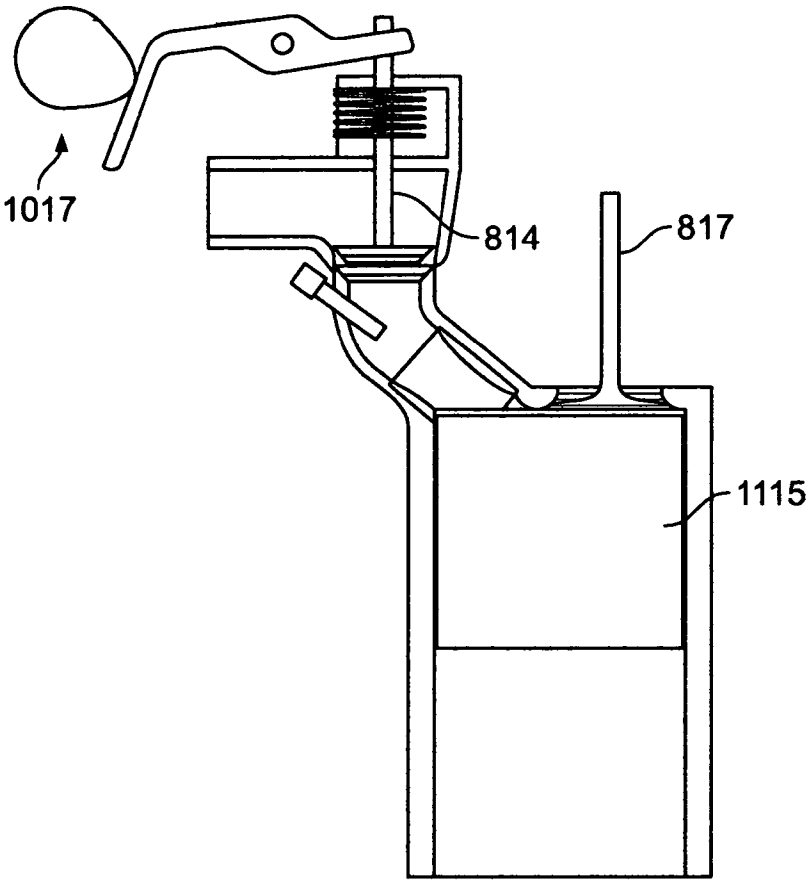
Figure 11D:
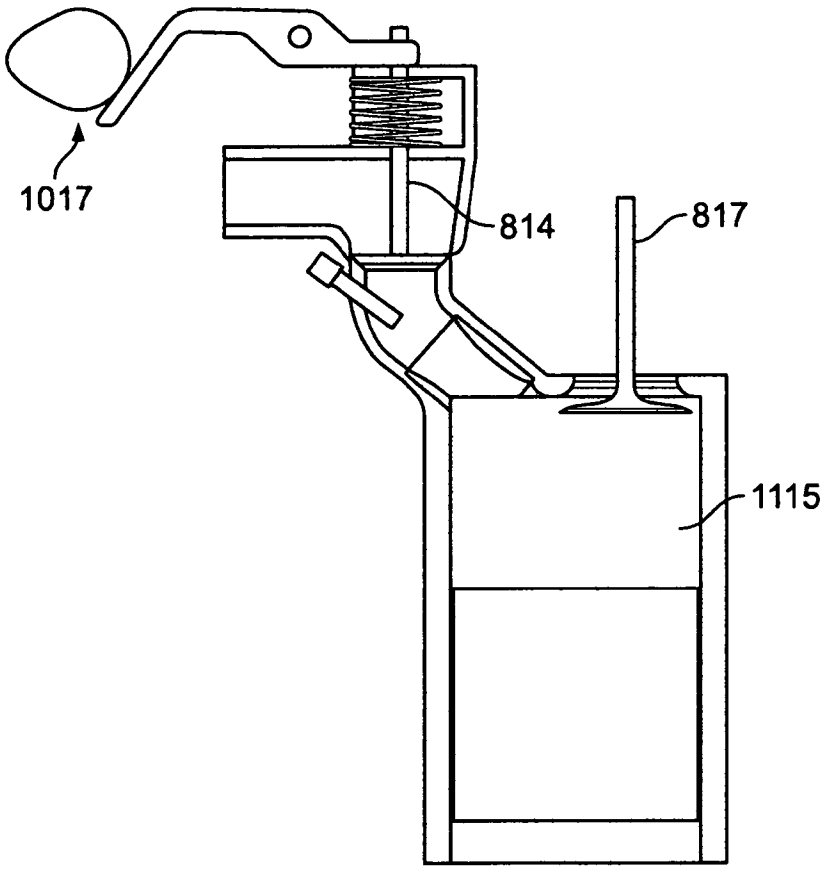
Figure 11C:
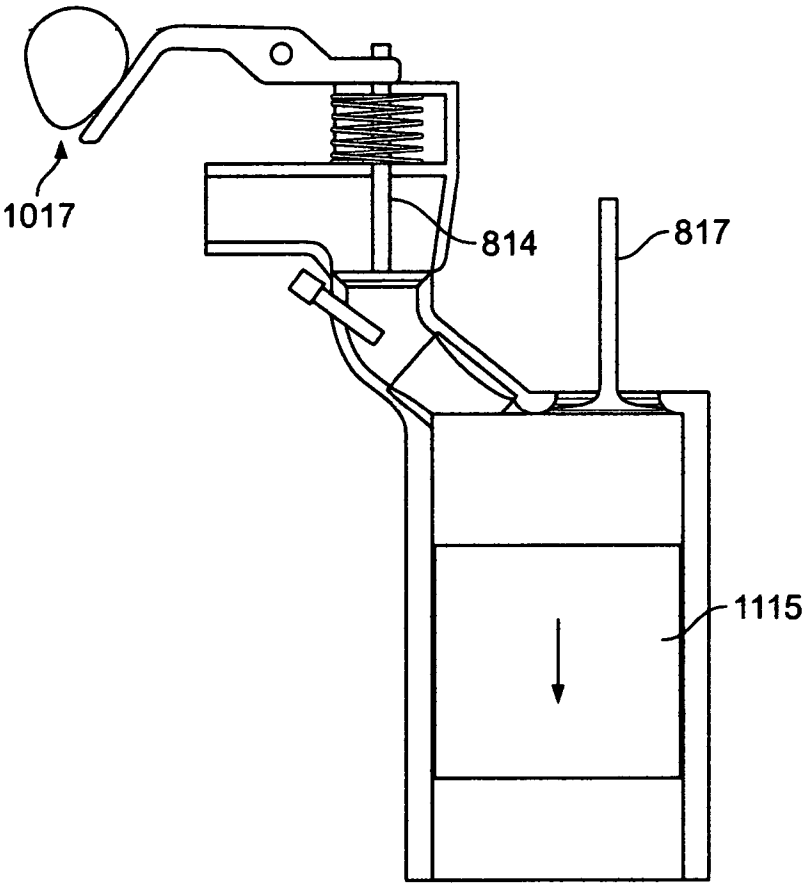
Figure 11F:
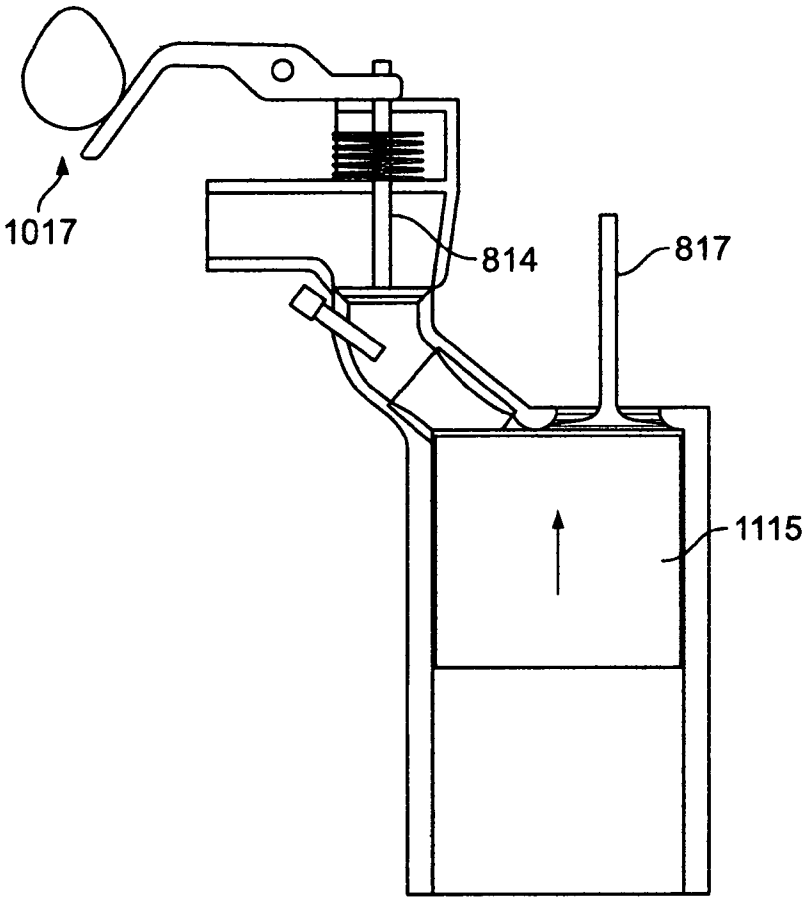
Figure 11E:
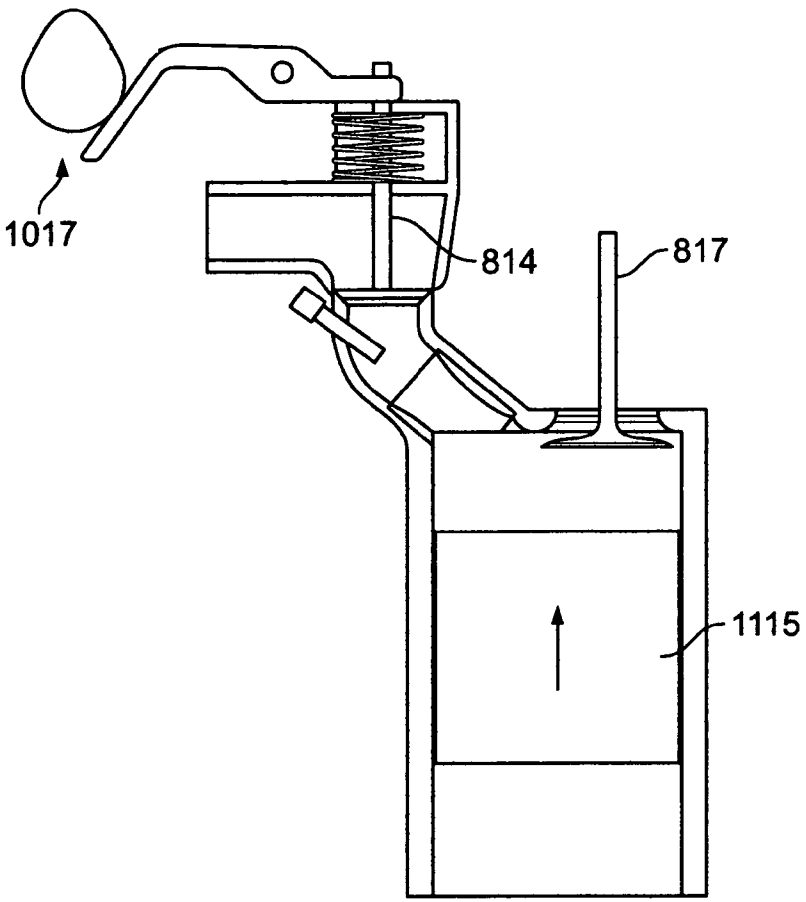

FIG. 10 shows an expander inlet valve design where the operation is "push to open."

FIGS. 11 A-F show representations of the expander at different points in the cycle.

Figure 12:
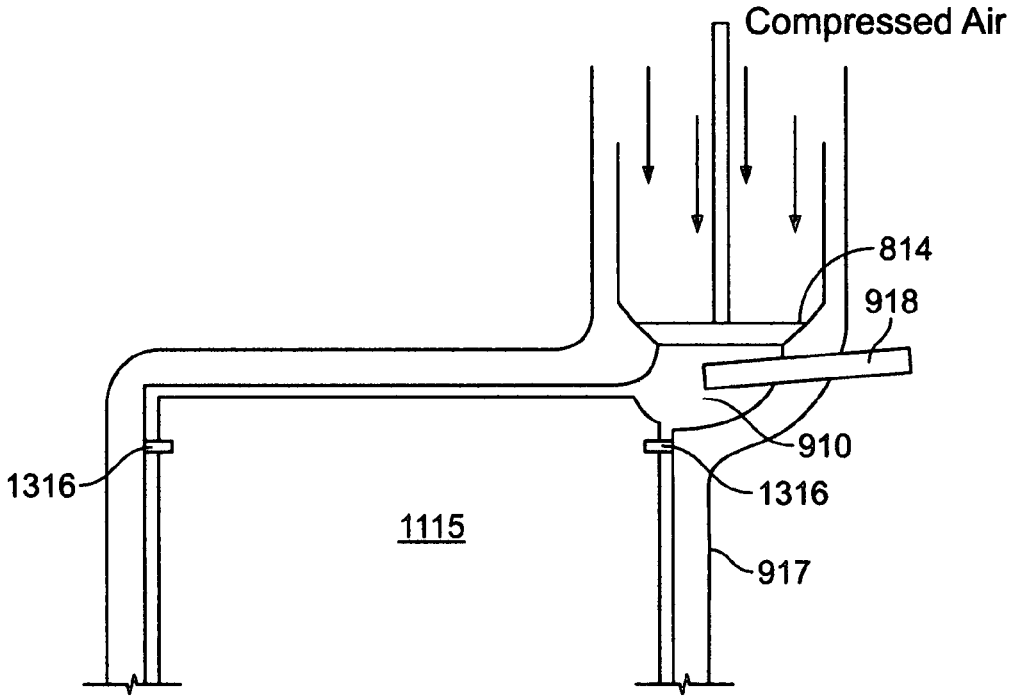

FIG. 12 shows an alternative expander air and fuel inlet design.

Figure 13:
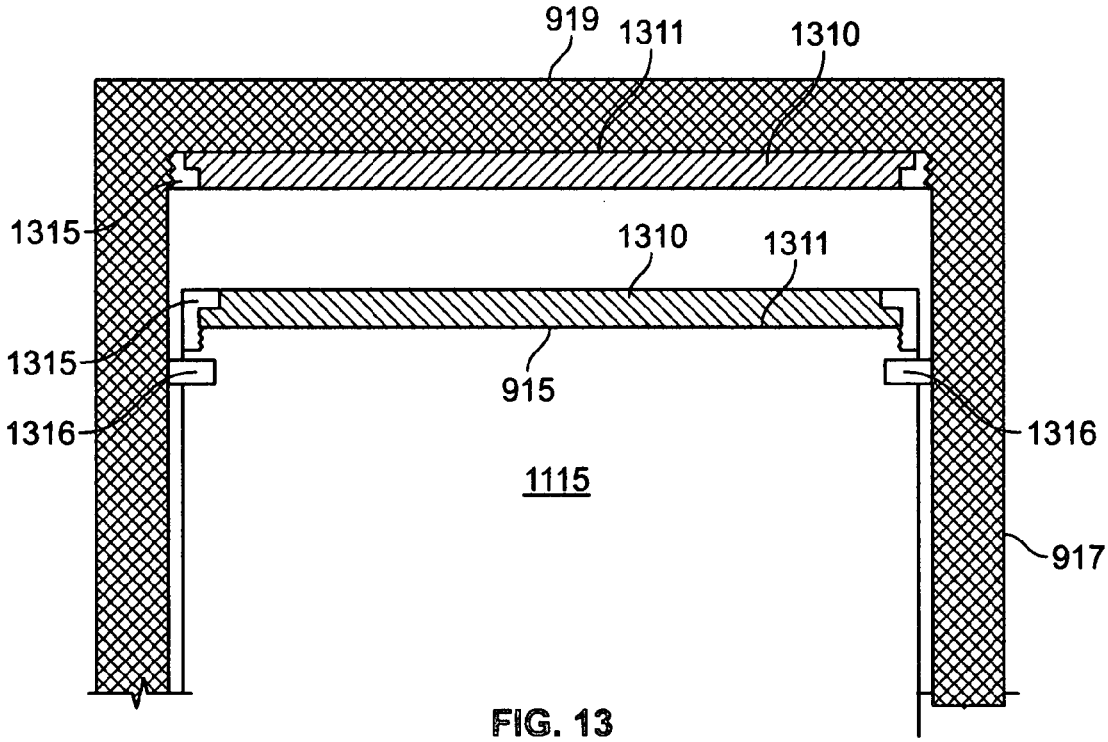

FIG. 13 shows thermal insulation detail for the expander.

Figure 14:
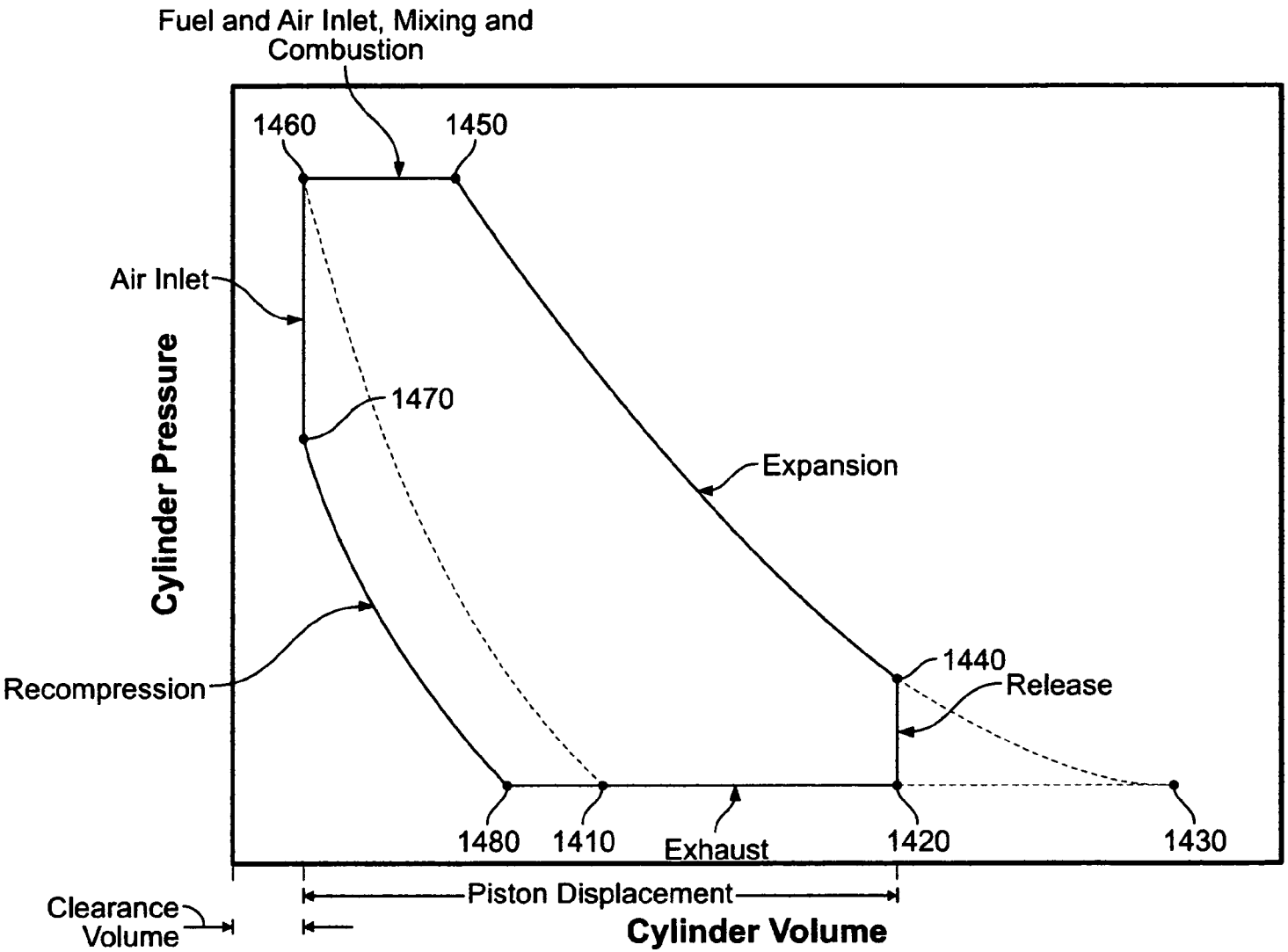

FIG. 14 shows a pressure-volume diagram for the expander.

Figure 15:
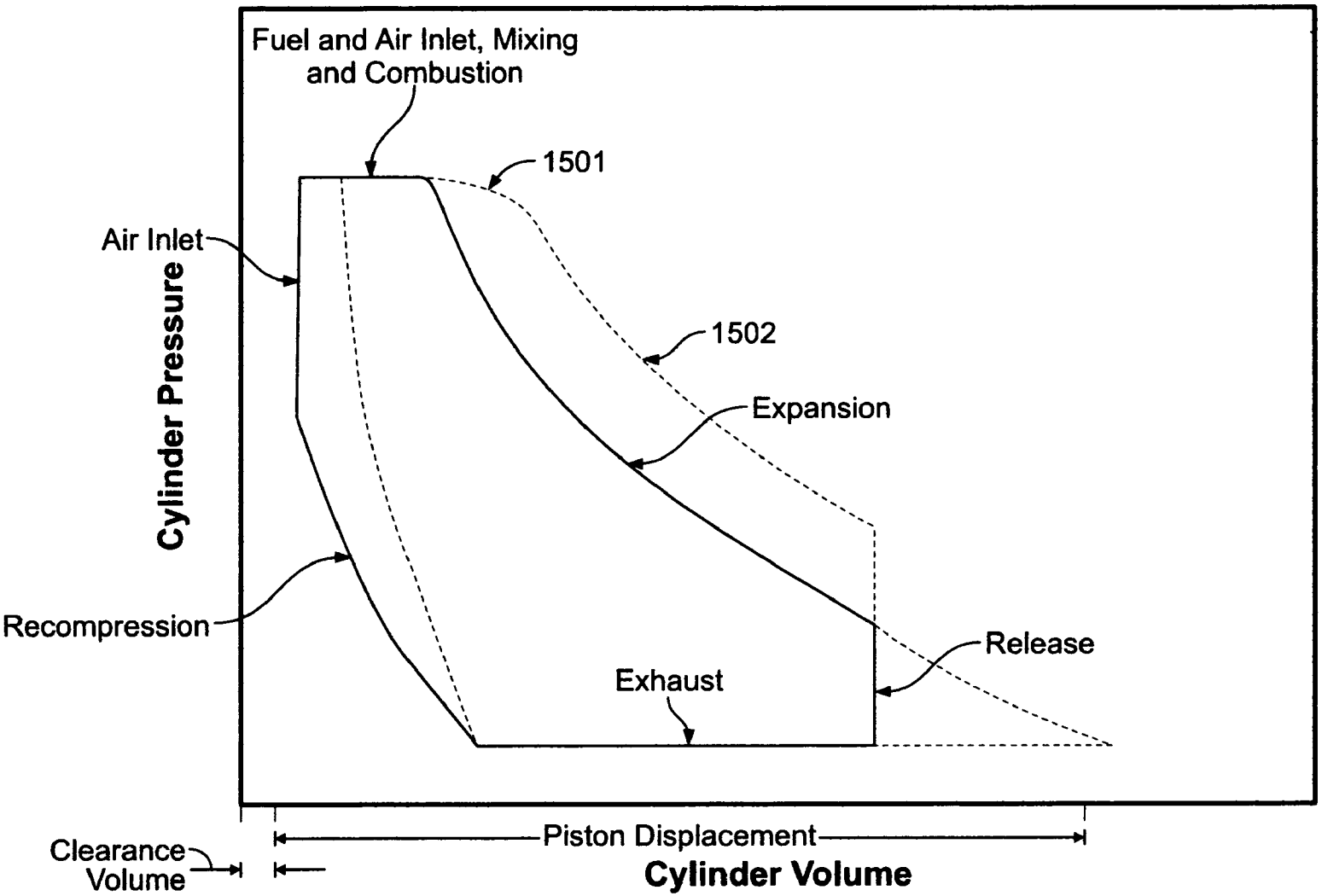

FIG. 15 shows an alternative pressure-volume diagram for the expander when the cycle includes prolonged combustion.

Figure 16:
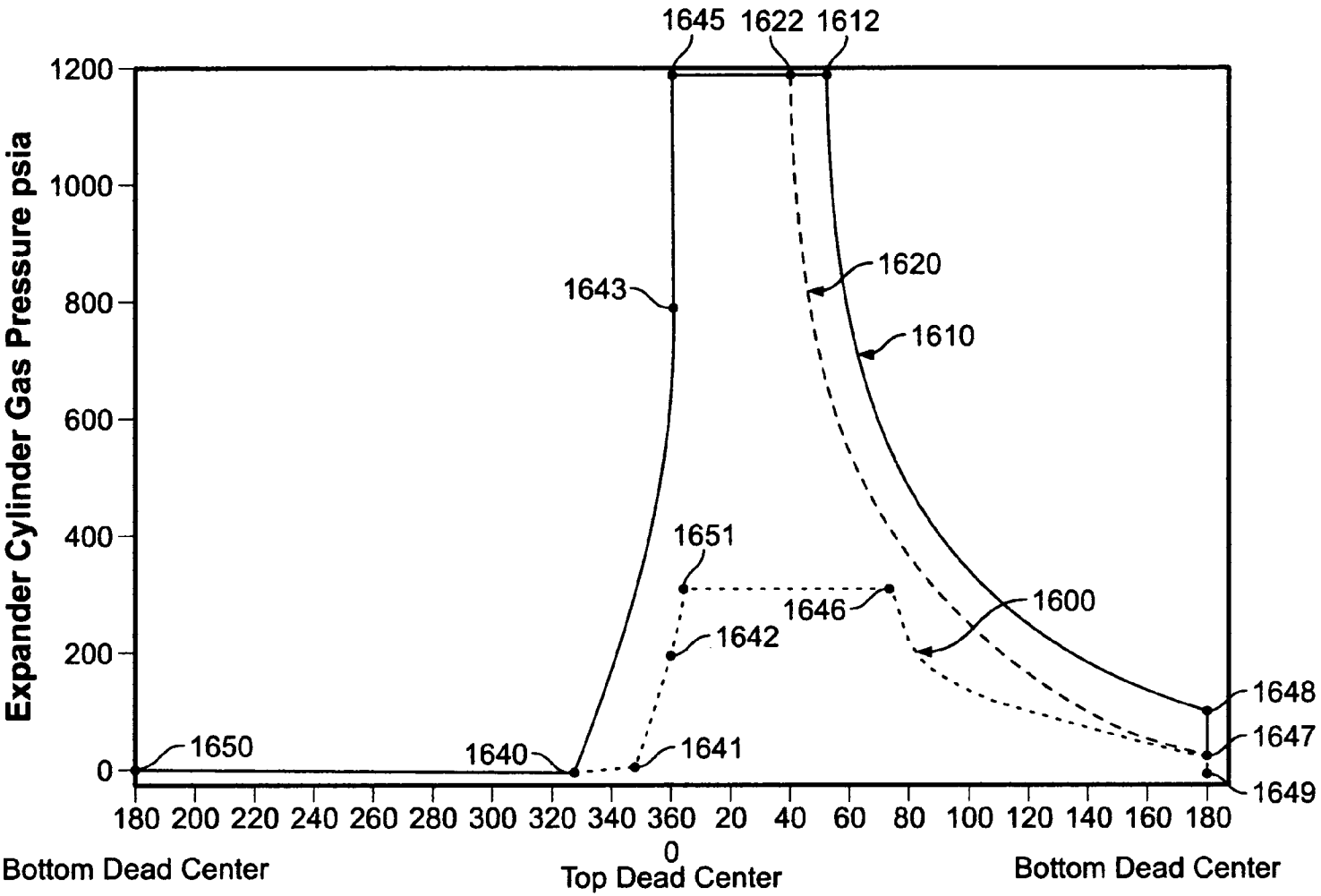

FIG. 16 shows expander pressure and volume diagrams.

Figure 17:
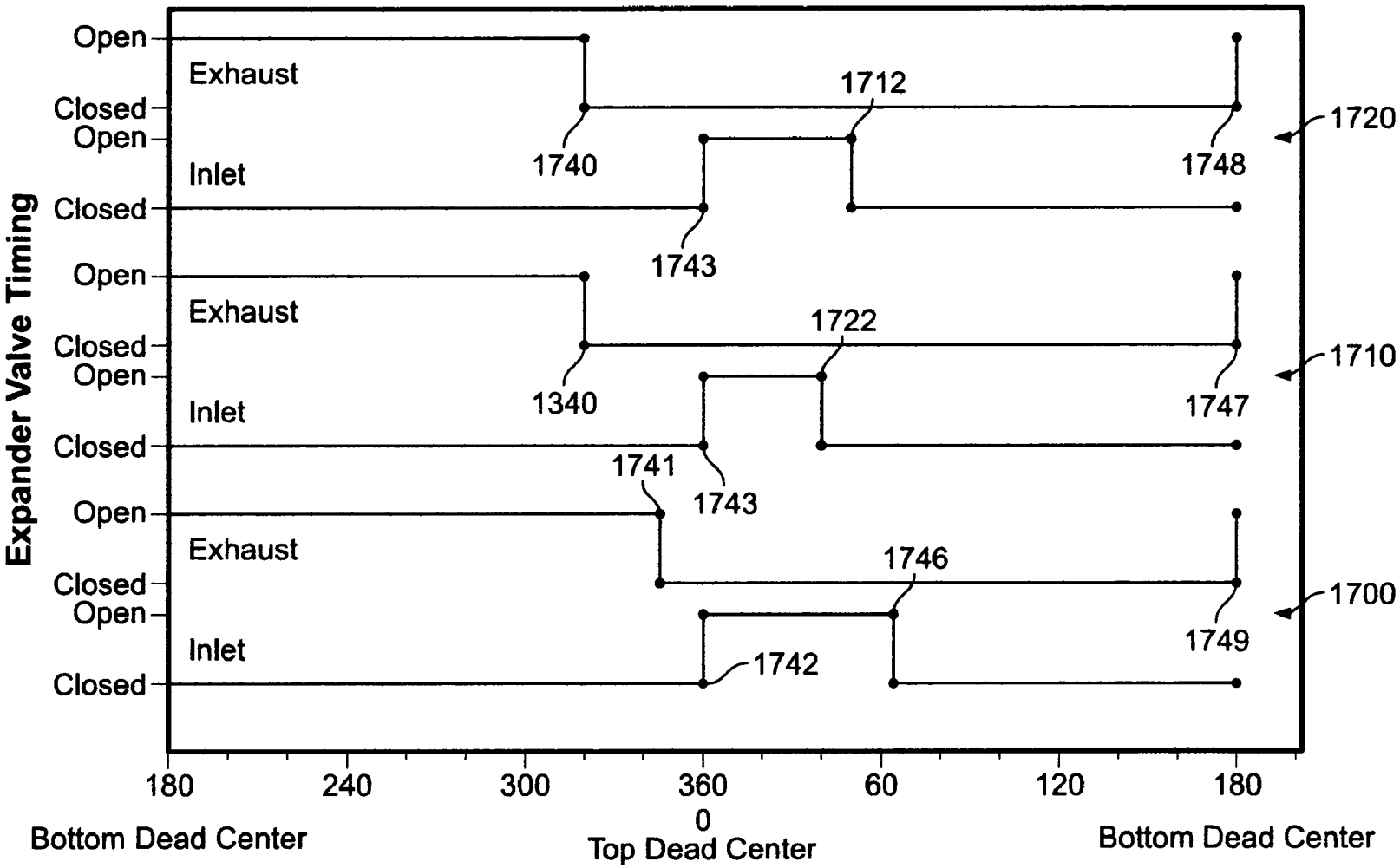

FIG. 17 shows expander valve timing.

Figure 18:
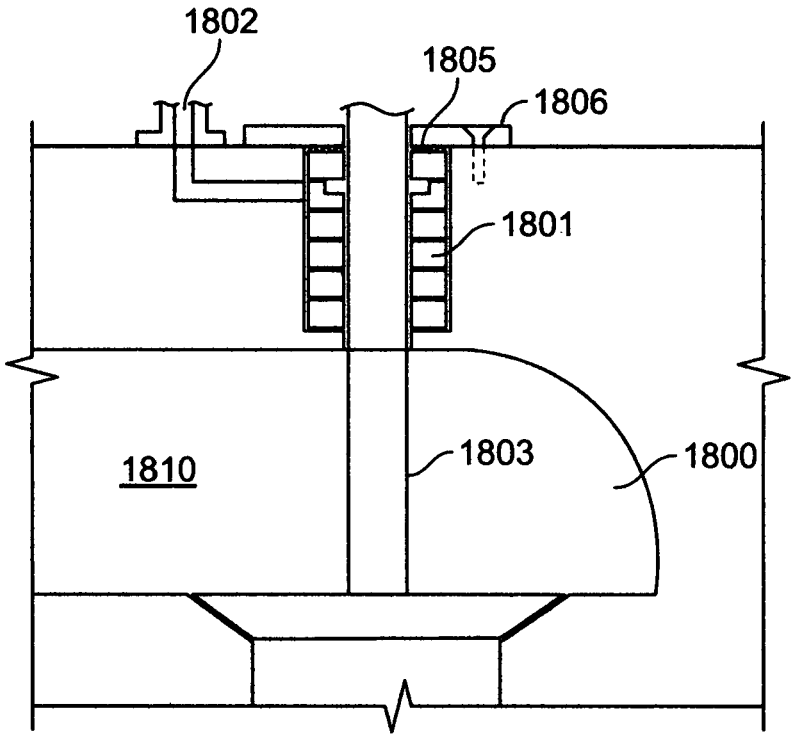

FIG. 18 shows a sealed valve stem design for piston compressor and expander valves.

Figure 19:
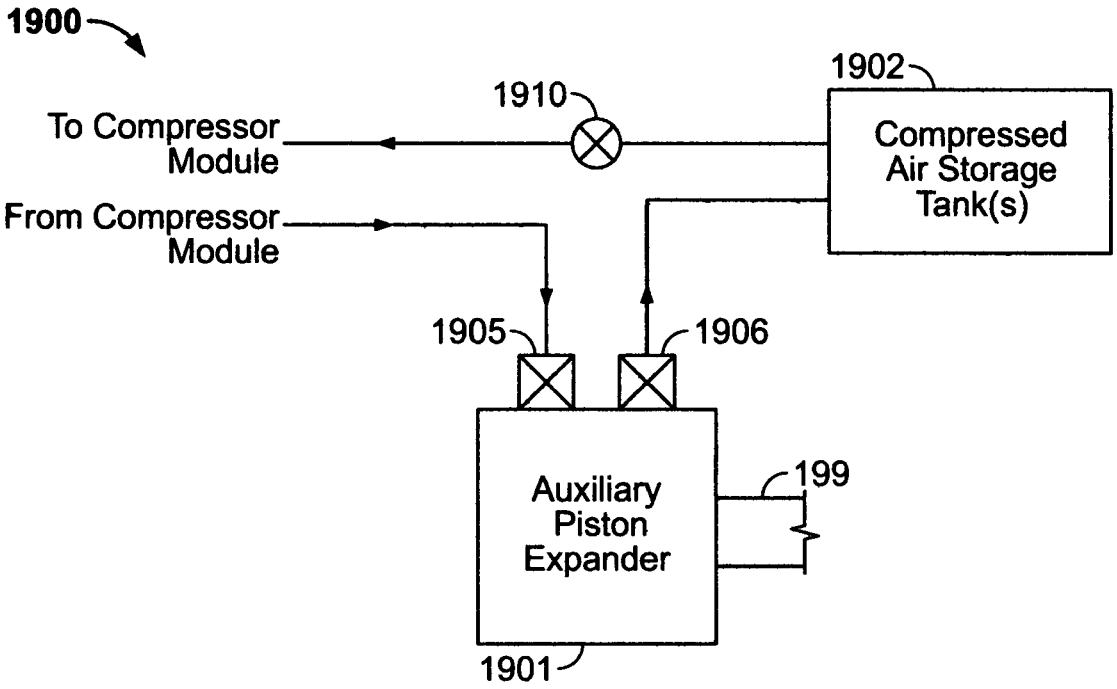

FIG. 19 is a schematic of the auxiliary compressor module.

DETAILED DESCRIPTION OF THE INVENTION

Figure 1:
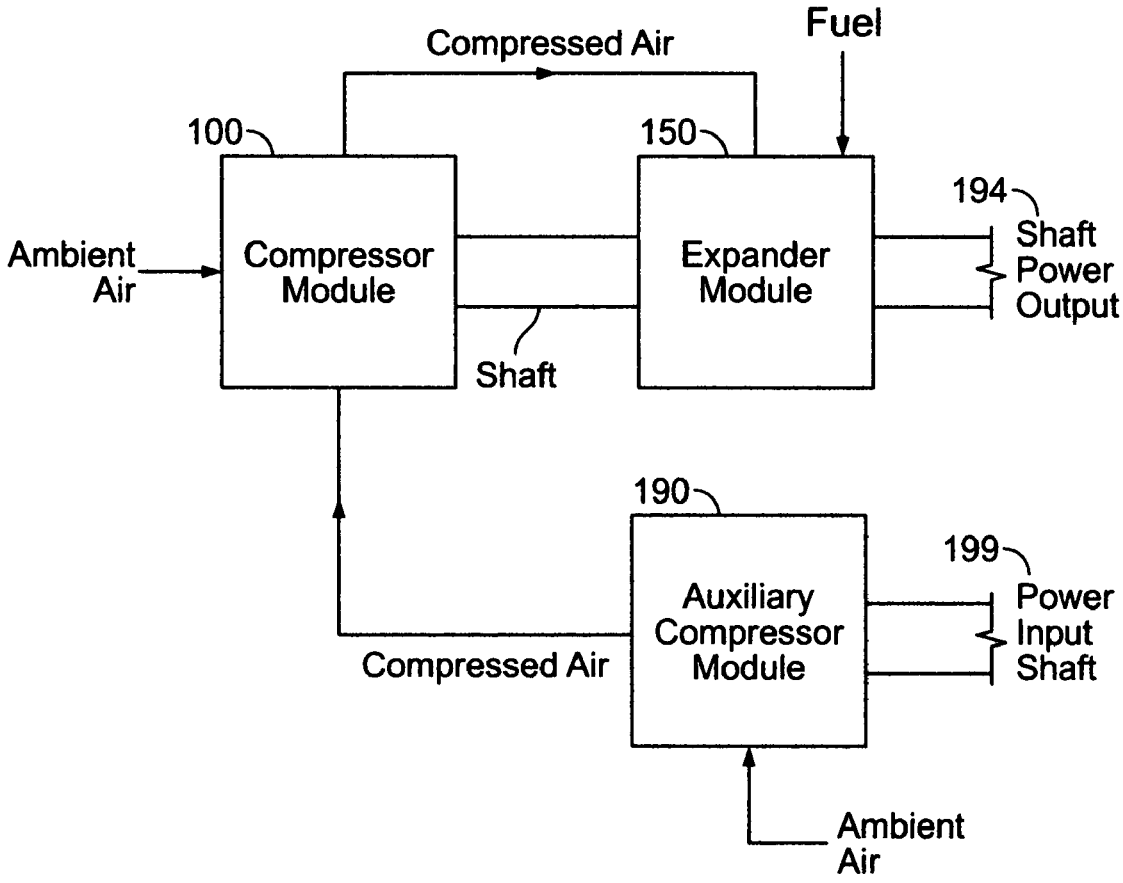
FIG. 1 is a block diagram showing the major components of the engine.

With reference to FIG. 1, the engine adapted to drive a shaft 194 comprises at least two separate and functionally independent modules, each of which is optimized to perform its particular task: the compressor module 100 and the expander module 150. In addition, the system may include an auxiliary compressor module 190. By separating the engine cylinders into air compression and gas expansion modules, these modules may be optimized for higher efficiency and the hot exhaust gases may be used to heat the compressed air prior to mixing with the fuel, thus reducing the amount of fuel needed to reach a given gas temperature after combustion.

The Compressor Module

Figure 2:
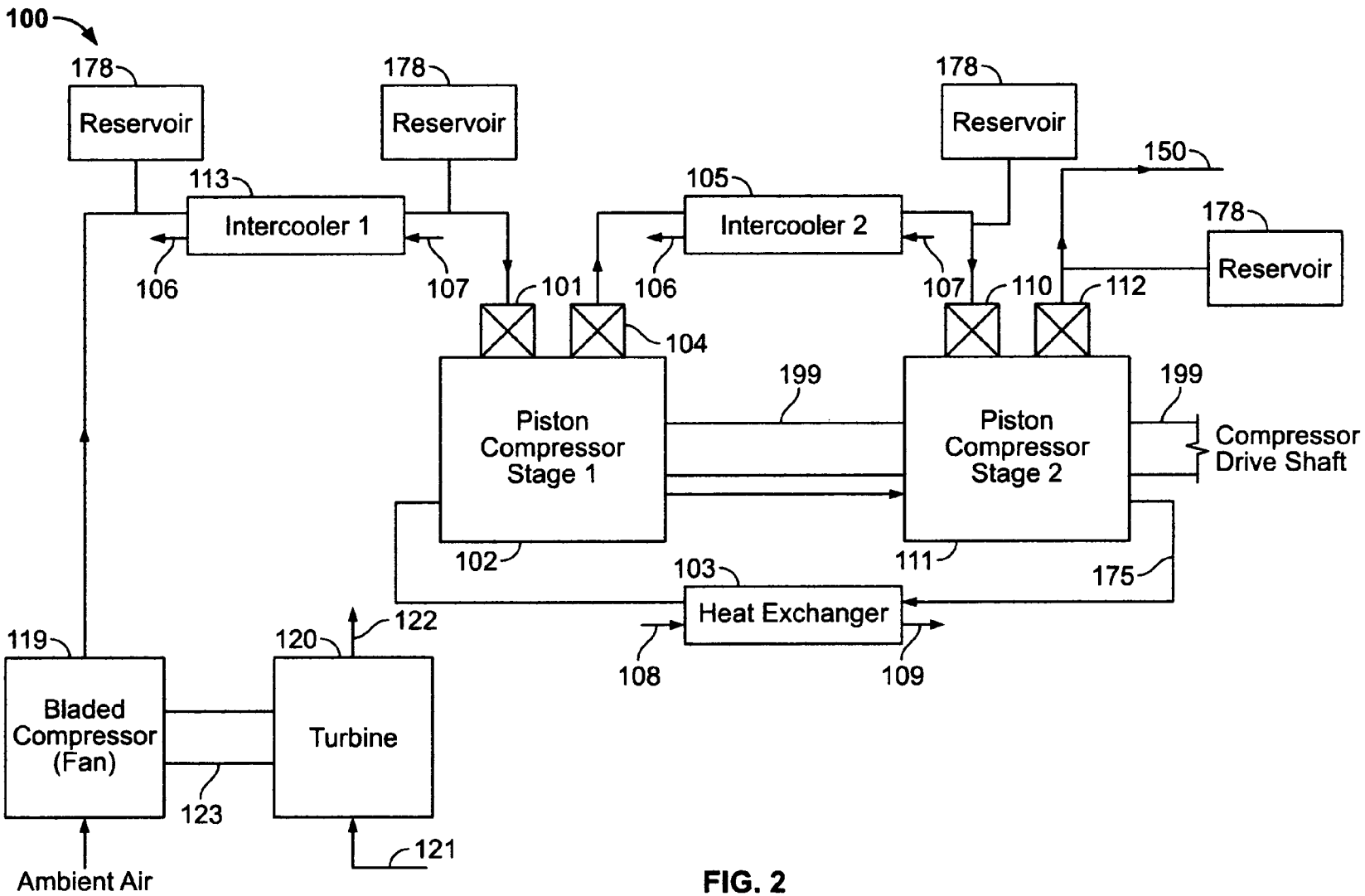
FIG. 2 is a block diagram showing the components of the compressor module.

With reference to FIGS. 1 and 2, the compressor module 100, preferably comprises two or more compressor stages 102, 111. In principle, any number of compressor stages may be used; the ideal number will be determined by a balance between pressure drop and frictional losses, overall cycle efficiency, and mechanical complexity. Two stages, as shown, may be used for minimal complexity, while three stages may be used for higher output air pressures and associated higher efficiency. At least one stage 102, 111 of compression has a piston-cylinder compressor or multiple piston-cylinder compressors operating in parallel. The devices may have conventional two-stroke operation with an inlet stroke filling the cylinder partially or completely with air at the inlet pressure and an outlet stroke that expels the compressed air. In parallel operation each cylinder operates with the same inlet air source pressure, and the same output pressure. The output mass flows from each cylinder are combined. Parallel piston-cylinder compressors may be phased to take in and deliver a more continuous, less pulsated combined flow rate. The two parallel compressors may be 180° out of phase, with one cylinder taking air in when the other is compressing and delivering air out. Three compressors may be phased at 0°, 120°, and 240° and four compressors may be phased at 0°, 90°, and 180°, and 270°. The reciprocating piston-cylinder devices with air inlet 101, 110 and outlet 104, 112 poppet valves having independent variable, controlled valve timing.

Additionally, a preliminary compressor stage 119 may utilize an axial or radial vaned or bladed compressor or fan. This fan or bladed or vaned compressor may also be turbo-dynamic and driven, via a shaft 123, by one or more turbines 120 utilizing expander 150 exhaust gas energy, wherein exhaust gas enters 121 the turbine 120 and subsequently exits 122 to the atmosphere. Ambient air can enter compressor stage 102 directly or first go through preliminary compressor stage 119 and an optional intercooler 113 described below. Air enters the compressor stage 102 through inlet 101 and is expelled at higher pressure through outlet 104. The compressed air flows through the optional intercooler 105 described below and into the second air compressor stage 111 through inlet valve 110 where it is further compressed and expelled through outlet 112 to the expander module 150.

Each compressor stage 102, 111 may be cooled by a combination of conventional lubricant, ambient air flow 108, 109, and flows of coolant 175 through the compressor structure. Preferably, the flows of coolant 175 pass through a heat exchanger 103, which may be conventionally made of metal, where they are cooled by the flow of ambient air 108, 109 or by other appropriate means. Although, for simplification, one heat exchanger with a single flow is shown in FIG. 2 cooling both compressor stages, it will be understood that two heat exchangers, with separate flows could be used or each compressor could have a separate flow to a single heat exchanger. By cooling the air at the surface of the piston, cylinder head, and cylinder walls, the air compression can be brought closer to an isothermal process, and to ambient air temperatures, decreasing compressor work and thus increasing the overall engine efficiency.

To cool the compressed air, and produce an associated improvement in engine efficiency by reducing the energy needed to further compress the air, intercoolers 113, 105 may be employed between the compressor stages 102, 111. If more than two compressor stages are included, an intercooler may be used between each of the compressor stages. The intercooler 113, 105 can be any device that cools the compressed air, but may be a conventional metal heat exchanger that cools the compressed air with a flow of ambient air 106, 107. Alternatively, water or other liquid coolant might be used for cooling, especially if the engine is to be used for stationary applications.

The engine has interconnection between inherently cyclic piston-cylinder devices—compressor stages 102, 111—and steady flow devices—intercoolers 105, 113 as well as the recuperator in the expander module 150 described in more detail below. Significant pressure changes at these interconnections can result in power losses and inefficiencies. To minimize the cyclic pressure changes of the compressed air in the system, there should be sufficient air volume in the intercooler 105, 113 or in the connecting duct if an intercooler is not used. Additionally, this engine may use accumulators or reservoirs 178 of added volume at these interconnections to reduce pressure changes to acceptable levels. Further, the phasing of the compressors 102, 111 is preferably optimized so that the volume increase of air at the input to the steady flow devices occurs at approximately the same time as the volume decrease at the output.

Figure 3:
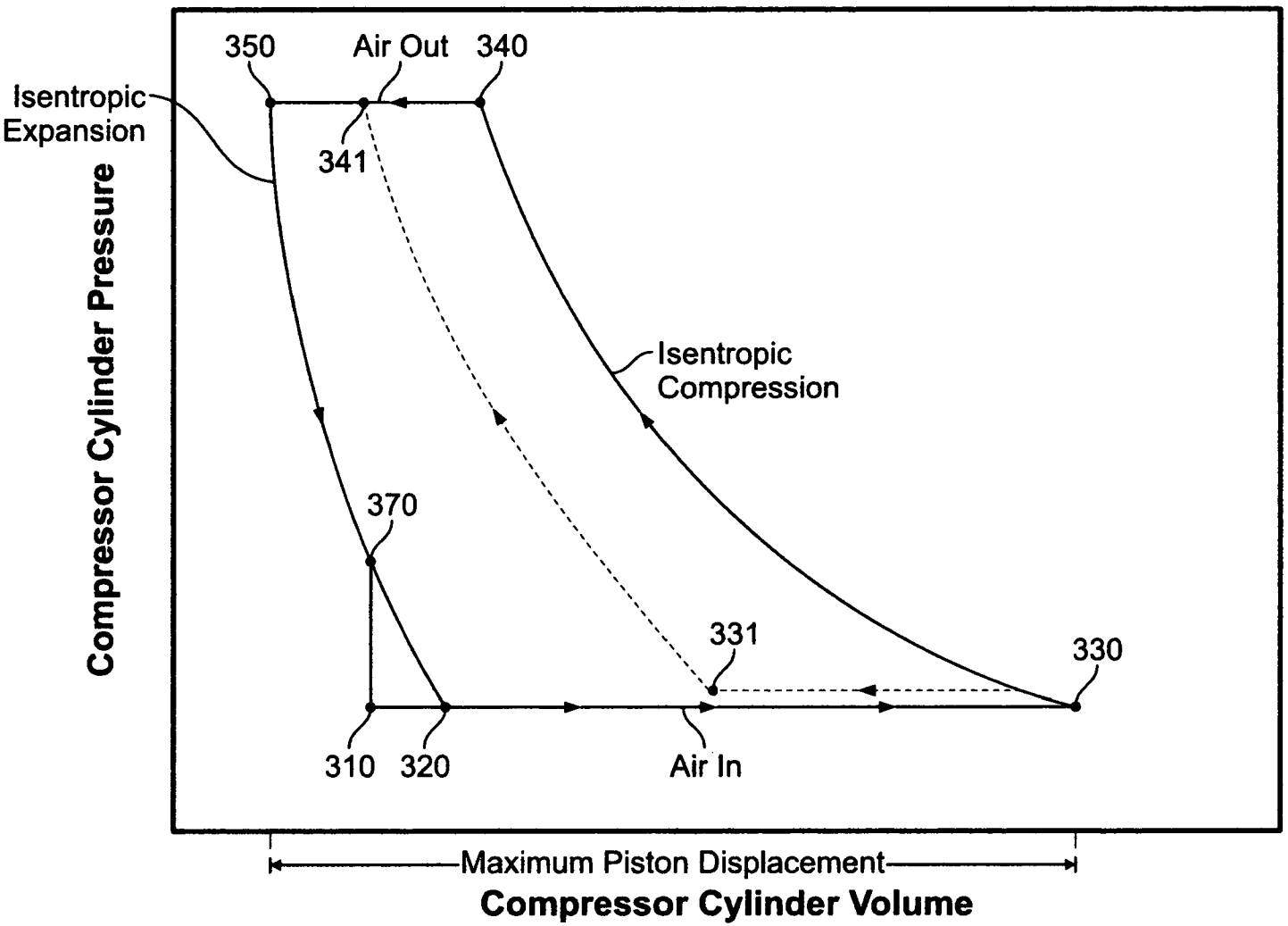
FIG. 3 shows the compressor pressure-volume diagram for each compressor stage.

The compressor cycle for the positive-displacement, reciprocating piston-cylinder device is shown in FIG. 3. The compressor stage takes in air starting at point 310 or 320. The inlet valve 101, 110 is open and the piston is moving toward bottom dead center, which is reached at 330. Reversible, adiabatic, isentropic compression occurs from points 330, 331 to 340, 341 creating the desired pressure at the outlet valve 104, 112 which opens at point 340, 341 and closes at point 350 when the piston reaches top dead center. Isentropic expansion of the compressed air in the clearance volume or dead space occurs completely from points 350 to 320 (i.e., the inlet valve opens at point 320). Alternatively, isentropic expansion occurs incompletely from points 350 to 370 to 310 (i.e., inlet valve opens at point 370).

Figure 4:
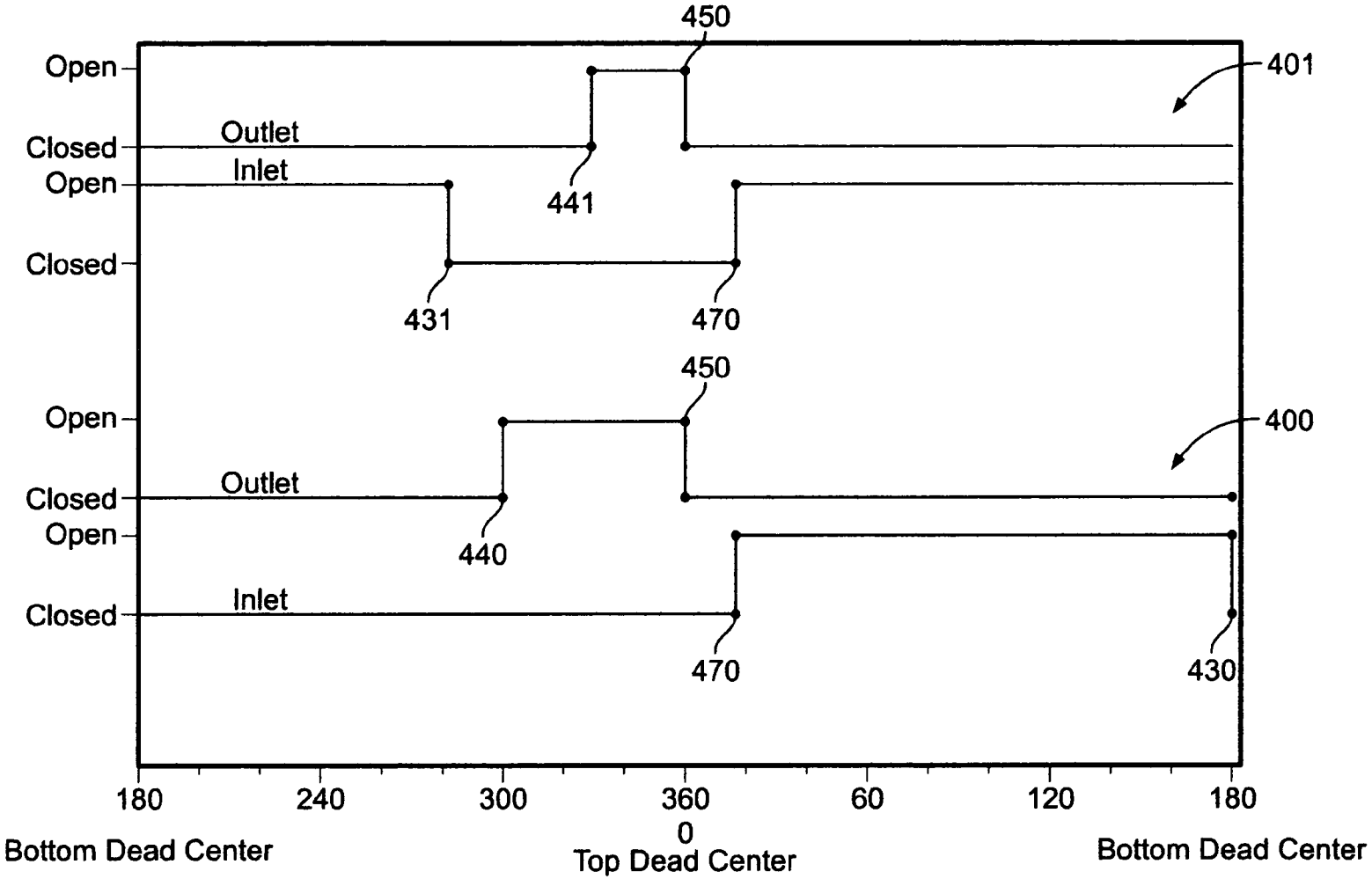
FIG. 4 shows alternative compressor valve timing based on the crank angle.

FIG. 4 shows the valve timing differences between the two cycles. The timing shown in 400 is associated with the pressure-volume path from points 330 to 340, while the timing shown in 401 is associated with the path from points 331 to 341. Note that for both cycles the outlet valve closes at point 450, at or near top dead center. The outlet valve may also be controlled as if it were a passive check valve, to open when the pressure in the cylinder is equal to the pressure downstream. A driven poppet valve will achieve timing control while also minimizing valve pressure drop which will allow efficient compressor operation at high compressor speeds.

The inlet valve timing controls the volume of air that is compressed, with the maximum volume of air compressed when the inlet valve closes at bottom dead center or point 330, 430. However, it is also possible to delay inlet valve closure to point 331, 431 when the piston is between bottom dead center and top dead center. Note that there is a corresponding change in the timing of the outlet valve opening from 440 to 441. Compression work is decreased, as is shown by the reduction of the area of the pressure-volume diagram in FIG. 3 between the paths 330 to 340 and 331 to 341; however, the inlet valve pressure drop, when air enters the compressor cylinder from points 310 or 320 to 330 and then leaves the cylinder back to the inlet from points 330 to 331, can be made negligibly small by using a large open valve flow area to maintain high compressor efficiency. By thus altering the volume, mass, and pressure of the air compressed each cycle, by means of the inlet valve timing, the overall power output of the engine may be controlled.

Poppet Valve Design and Actuation

Figure 5:
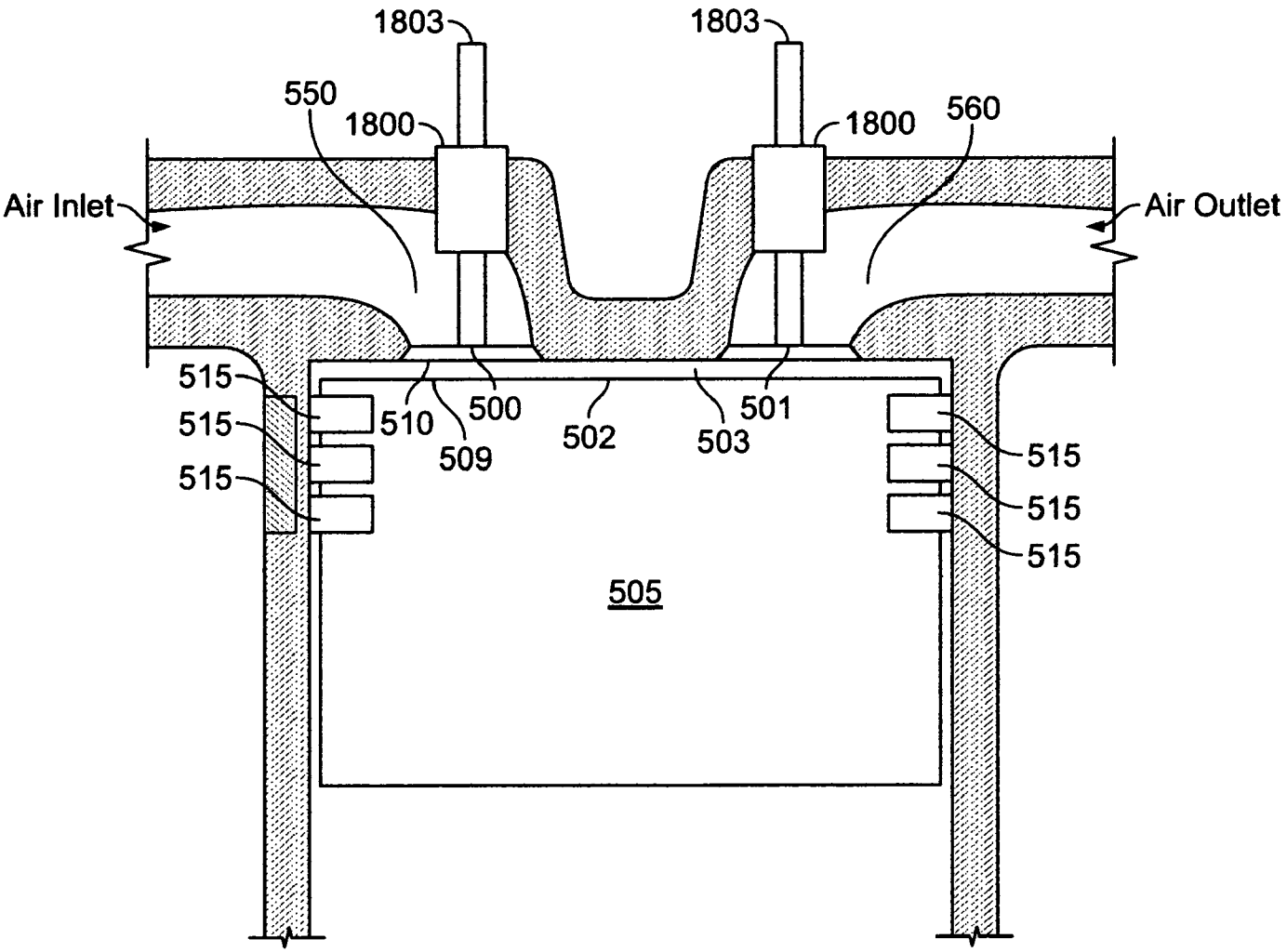
FIG. 5 shows a representation of a compressor stage, with inlet and outlet poppet valves.

The inlet 500 and outlet 501 poppet valves and other features of the piston compressor are shown in FIG. 5. This design preferably uses a flat piston face and flat cylinder head with the smallest possible distance tc 502 and gap volume Vc 503 when the piston 505 is at top dead center, the closest the piston face 509 comes to the cylinder head 510. The gap volume 503 is kept low to minimize compressor work.

Possible cam drive mechanisms for the compressor inlet valve and for the piston compressor and expander outlet valves are shown in FIGS. 6-7. Within a cylinder 630 each poppet valve 600 has a round poppet 601 with a tapered or angled circular outside sealing surface 602 that mates with an angled valve seat 603 to provide gas-tight sealing when the valve is closed. A valve stem seal 1800 may be used on the poppet valves' stems 1803, which is further described below in connection with FIG. 18.

Each valve is held closed by a valve spring 605 and is opened by a rocker arm 606 pushing on the end of the valve stem 607, or, alternatively, a cap over the valve stem. The rocker arm 606 is moved by one or more cams 610, 611 mounted on a camshaft 612 that is rotated at the same speed as the piston crankshaft. The rocker arm 606 is operably connected to the cams 610, 611 via a cam roller follower 620 and pivot 621. Valve timing may be changed by rotating one cam relative to another in order to increase or decrease the overlap of the two cam profiles. One cam 610 is fixed to the camshaft and the other cam 611 is rotated relative to the fixed cam by axially moving a collet 615 mating to an angled or helical spline 616 on the camshaft 612. Guide pins 617 attached to the rotating cam 611 slide in holes in the collet 615 and force the cam, which does not move axially, to rotate relative to the fixed cam 610.

As an alternative to the valve design above, FIG. 7 shows a design comprising a three-dimensional cam 700 that can be moved axially on the camshaft 705, including axial splines 706, but not rotated relative to it. The cam profile provides changes in valve timing according to the axial position of the cam relative to the cam roller follower 710 on the rocker arm 711.

The compressor stages are preferably driven by the expander module 150, further described below, using a common crankshaft or by using separate crankshafts 199 coupled together directly or indirectly, such as by gears or by pulley and belt systems, or by using an electrical motor.

The Expander Module

With reference to FIGS. 1, 8, 9 and 10 the expander module may comprise one or more two-stroke, reciprocating piston-cylinder expanders 816 with air inlet 814 and exhaust 817 valves, preferably poppet valves described above, having independent, variable, controlled timing for opening and closing which is described in detail below.

The inlet valve 814 controls the flow of air into the expander duct 910 and cylinder 916 in that it turns on and off the flow of the compressed air. The valve merely opens and closes; it does not control the rate of flow, which is instead controlled by the velocity of the piston 1115. Valve timing is further described in detail below.

A poppet valve, operated by a rocker arm 1010 driven by a cam 1017 or crankshaft, as described above with respect to the compressor may be used to implement the inlet valve 814 opening, which usually occurs at or near top dead center. A spring 1015 may be used to keep the valve in a normally closed position. The same or a second cam acting on the same rocker arm 1010 may be used to close the inlet valve 814. The expander inlet 814 valve may be designed to open when a cam-actuated rocker arm 1010 pushes down on the top of the valve stem 1018, as shown in FIG. 10. Pushing on the top of a valve stem is the conventional method for opening poppet valves. In this design, however, the valve stem 1018 passes through the inlet air duct 1019 and the valve sealing member 1020 moves into the compressed air inlet duct. The cam 1017 may contact a roller follower 1021 attached to the rocker arm 1010, or alternatively may be in direct operable contact with a portion of the rocker arm itself. An alternative to the use of a rocker arm is to allow the cam to contact the top of the valve stem directly or with an intermediate component guided along the axis of the valve stem.

As shown in FIG. 11, the expander inlet valve seat may be structured so that the valve 814 is lifted up off the seat 960 rather than being pushed down from the seat towards the duct 910. In the design shown in FIGS. 10 and 11 the compressed inlet air pressure keeps the valve closed because the pressure in the cylinder 916 is less than the inlet air pressure at all times. In the designs shown in FIGS. 11 and 12, the valve 814 may be lifted using a cam 1117 and rocker arm 1121. The rocker arm 1121 lifts the valve 814 away from the valve seat 960 against the biasing (valve closing) force of the spring 1015. The cam on a camshaft 1025 contacts the other end of the pivoted 1026 rocker arm 1121 to control the valve 814 lifting and timing. To increase valve life and reliability, reduce valve drive forces, reduce the required valve mass, and reduce noise, both opening and closure of the valve 814, for the designs of FIGS. 10 and 11, occur when the net pressure force on the valve 814 is close to zero by ensuring that the inlet air pressure and expander pressure are nearly equal when the valve is opened after exhaust gas recompression and when the valve is closed after combustion, as further described below. It should further be noted that when the valve 814 closes, and air flow becomes restricted, a pressure differential will occur that provides a net force in the direction of valve 814 closure, helping to ensure rapid and positive closure.

The valve 814 opening and closing may be adjustable if necessary to accommodate a wide engine RPM range using cams that rotate relative to the camshaft driving them, similar to the manners described above in FIGS. 6 and 7 in connection with compressor valve timing control, or some by other means known in the art. For example, two cams could contact a pivoted rocker arm; one cam controlling the inlet valve closing time or crank angle, and the other cam controlling the inlet valve opening time.

From the inlet valve 814, the heated, compressed air flows into a duct 910 that runs between the inlet valve 814 and the piston-cylinder space. Fuel 970 is metered or sprayed into the duct 910 by means of an injector 918. It will be appreciated that the injector 918 may spray small droplets of liquid fuel or, alternatively, jets of gaseous fuel, at high pressure. The heated, compressed air flows around the injector 918, and the fuel and air mix in the upper region 912 of the duct 910. The duct 910 is preferably insulated against heat loss and may utilize ceramic insulation and includes a flattened or elliptical center and outlet end portion 930, which is further described below. The duct 910 may also utilize a ceramic insert isolated from its external support structure by metal, metal foil and/or thin ceramic spacers providing contact resistance or low thermal conductivity materials and designs.

The flow rate and amount of fuel injected is controlled to maintain a constant fuel-air ratio and constant combustion temperature in the cylinder(s) 916 of the expander. The mixing induced by the shape of the duct at its center portion and outlet end portion 930, the high velocity of the air flow and the turbulence in the duct 910, combined with a gaseous or very fine spray of liquid fuel promote good fuel-air mixing before combustion begins. The premixing of the air and fuel streams between the inlet valve 814 and the cylinder 916 prior to combustion in the expander cylinder 916 described above is a process important for minimizing pollution emissions from this engine.

With reference to FIG. 11 A, with the piston at or near the top dead center of the piston stroke, at near minimal cylinder volume, the hot compressed air/fuel mixture is introduced into the cylinder 916 of the expander 816. Preferably, to improve efficiency, both the piston face 915 and the opposing cylinder heads 919 are substantially flat, with minimal clearance between them to minimize the volume at top dead center.

With the optional use of the exhaust gas to heat the compressed air in the recuperator 802 as further described below, any decrease in the exhaust gas temperature will result in a decrease in the expander inlet air temperature, thus requiring more fuel to reach the maximum gas temperature in the expander 816 during combustion. Therefore, to increase fuel efficiency, both the piston face 915 and the opposing cylinder heads 919 may be insulated so as to prevent heat loss that would reduce the exhaust gas temperature. Thermal insulation may be provided using flat ceramic disks 1310 as shown in FIG. 13 or, similar ceramic coatings or, alternatively, using high temperature metals and low thermal conductivity structure. Metal foil layers 1311 may be included between, for example, ceramic inserts 1310 and the metal structure of the piston 915 or cylinder head 919. These foil layers provide a thermal contact resistance that reduces heat flow from the hot ceramic parts to the metal structure at an acceptably low temperature. The ceramic disks and foil layers may be held in place by threaded retainers 1315 or other conventional means known in the art.

With reference to FIGS. 11 B and C, as the piston 1115 moves toward the bottom of its stroke the inlet valve 814 closes. Subsequently, as the piston 1115 continues to move towards bottom dead center, the hot compressed air/fuel mixture expands. The velocity and mass of the compressed fuel mixture, and thus the flow of air into the duct 910, are determined by the piston speed, which is at zero at top dead center and increases until the inlet valve 814 closes when the piston has moved some distance away from top dead center, perhaps between 5% and 20% of maximum piston travel or displacement. The timing of the piston operation is further described below.

Fuel continues to be injected into the heated airflow until approximately when the inlet valve closes, with the injection rate increasing as the air flow increases in order to maintain an approximately constant air/fuel ratio. It will be appreciated that the injection of fuel as described herein prevents any risk of engine knock since there is no combustible mixture in the cylinder until after the piston reaches top dead center.

Ignition may be initiated by means of the hot duct wall and expander surfaces in combination with the compressed air previously heated by the exhaust gases in the recuperator 802, although other, conventional, means might be used. It should be noted that no spark or glow plug 920 is needed during operation of the engine, but might be required at engine start up, until the surfaces and inlet air reach a sufficiently high temperature to effect ignition.

After ignition, the air and fuel continue to mix in the duct 910 but burn primarily in the cylinder 916 as a result of the high velocity of the air flow that occurs shortly after the piston 1115 moves from the top dead center position. The mixture exiting the duct 910 is ignited by the combustion in the cylinder 916. The result is a torch-like combustion with a relatively short flame that is stabilized at the entrance to the cylinder 916 and resembles a gas turbine combustion process carried out intermittently. The compressed gases are heated from a temperature of approximately 800° K-1200° K to temperatures on the order of 1800° K-2600° K. The torch flame impinges at its periphery on the insulated piston face 915 and cylinder head 919 which, because of insulation, are at a high temperature, preventing surface quenching of the flame. Since combustion is completed within the torch flame there is no unburned fuel-air mixture in the cylinder for the combustion to extend into. The combustion products from the flame mix with gases in the cylinder before contact with the cooler cylinder walls 917. The instantaneous heat release is about proportional to the instantaneous fuel flow rate. The burn continues until the flow of air is stopped by the closing of the inlet valve 814 and the fuel injection ceases. Combustion is expected to end quickly, within microseconds after fuel injection stops, approximately when the air inlet valve 814 closes. It should be noted that detonation or unusually high peak cylinder pressures are prevented by the short ignition delay due to high compressed air temperatures and air-flow-controlled combustion process in which the inlet valve is open during combustion. It will be appreciated that given the similarities between the current invention and gas turbine combustion, mechanisms currently used in the art to enhance the pre-evaporation and pre-mixing of fuel and air before combustion, and achieve low pollutant emissions in the gas turbine, may be used successfully in the engine described.

To minimize efficiency losses, it is desirable that the pressure in the cylinder 916 at the time the inlet valve 814 is opened be at approximately the same or slightly below the pressure as the incoming compressed air. This is desired in order to compensate for the potentially degrading effects of clearance volume—the volume in the cylinder 916 between the piston 915 and the cylinder head 919 when the piston is at top dead center—and the unavoidable "dead space" associated with the air inlet duct 910 of the expander and other crevices and volumes. With reference to FIG. 14, by selectively timing the opening and closing of the input and output valves as further described below, the expander exhaust is recompressed either completely as shown by the path from 1010 to 1060, or partially, as shown by the path from 1080 to 1070. The extent of recompression depends on whether the exhaust valve 317 closes at point 1010 or 1080. This recompression of exhaust fills the clearance volume and dead space with the exhaust gas reversibly and adiabatically, or isentropically, to a pressure at or somewhat below the air pressure at the inlet valve 814. The position of the piston as the gas is being recompressed, part way from bottom dead center, at a point between 1070 and 1060 in FIG. 14, is shown in FIG. 11 F. To the extent that the exhaust is not recompressed, the incoming compressed air fills the clearance volume, increasing the mass of compressed air that flows into the expander 150 and thus decreasing system efficiency. With exhaust recompression to inlet air pressure levels no incoming compressed air fills the clearance volume because this volume is already filled with recompressed expander exhaust gas.

FIGS. 5 and 10 show the $t_c$ or clearance distance 502, 1017 and $V_C$ or clearance volume 503, 1032 at top dead center for the compressor and the expander, respectively. As suggested in the discussions above, it is desirable to minimize these parameters to maximize system efficiency. It is therefore preferable that the piston faces and cylinder heads be substantially flat and that the piston face and cylinder head surface area be minimized, thereby minimizing heat losses at these surfaces and decreasing the total "dead space" in the system. It is further preferable that the minimum clearance gap be a small as possible. Ideally, by reducing the clearance volume, the total "dead space" including ducts and the like, for the compressor or expander is also reduced to a minimum, that is, less than 3 to 5% of the total device volume when the cylinder volume is at a maximum.

As shown in FIGS. 9, 10 and 12, and suggested in the discussions above, it is desirable that the duct 910 have a flattened or elliptical center and outlet end portion 930, and that the duct is shaped and positioned such that the exit to the cylinder 916 is narrow in the direction of the piston's motion and face 915 but wide in the direction that is substantially parallel to the cylinder head 919. It is desirable for fuel spray to be configured to fit this shape, with possibly an array of fuel sprays in a plane parallel to the cylinder head and/or baffles or shields that direct the spray into such a shape, so that, preferably the spray is directed in a narrow plane parallel to the piston face and/or the cylinder head.

With further reference to FIGS. 14 and 11 F and as noted above, the exhaust and inlet valves are both closed at points 1410 or 1480. With reference to FIGS. 11 A and B, the inlet valve 814 opens either at point 1470 or 1460 and compressed air flows into the expander 816. The fuel flow is metered into and mixed with the air flow, with torch-like combustion as described above and the associated increase in the temperature of the compressed gas, as described above, between points 1460 and 1450, the airflow increasing from a rate of zero at point 1460 as described above and shown in FIG. 11 A and to a maximum at point 1450 where the inlet valve closes, as shown in FIG. 11 C. It will be noted that the pressure remains essentially constant from point 1460 to 1450 since the inlet valve 814 remains open. As shown in FIG. 11 C, at point 1450, the inlet valve 814 closes, while the exhaust valve 117 remains closed and the piston continues to move to near bottom dead center at point 1440. The process between points 1450 and 1440 is essentially reversible and adiabatic or isentropic. Gas pressure decreases as cylinder volume increases, and work is extracted by the expander as shown in FIG. 14. Preferably, the minimum pressure reached is greater than ambient air pressure. At point 1440 the exhaust valve 817 opens as shown in FIG. 14 D. When the exhaust valve opens there is appreciable pressure in the cylinder 916 and the exhaust gas rushes out to ambient air or through the optional recuperator 802 at essentially constant and near-ambient air pressure as the piston moves back toward top dead center as shown in FIG. 11 D. The pressure may exceed ambient due to pressure drops in valves, ducts, the recuperator 802, and the exhaust system (not shown). It will be noted that the area of the diagram shown in FIG. 14 between points 1440, 1430 and 1420 represent work output from the expander that is lost. However, the cylinder volume required for the "full" expansion increases cylinder size and thus weight and frictional losses. In addition, when the recuperator 802 is included in the system, a unique feature of the present invention is that this loss in work does not necessarily decrease the overall efficiency, since the higher temperature of "release" heat content at the exhaust at point 1440 compared to point 1430 results can be used to heat the incoming compressed air to a higher temperature. The exhaust valve 817 remains open until points 1410 or 1480, shown in FIG. 11 F completing the cycle.

As an alternative to the cycle shown in FIG. 14, FIG. 15 shows that fuel-air mixing and combustion after inlet valve closure, corresponding to FIG. 11 C, can result in an increase in the duration of the expander peak pressure along path 1501. It also results in expansion 1502 at higher pressures and an increase in expander work output but little change in modular engine efficiency. This method to increase work and power output may be desirable in some applications.

More generally, it should be noted that the input and output valve timing of the expander can be varied to control pressure levels and durations and ultimately the power output of the system. With reference to FIGS. 16 and 17, gas pressure diagram 1600 corresponds to timing chart 1700, 1610 to 1710, and 1620 to 1720. Pressure begins to rise in the cylinder as the exhaust valve closes at 1640, 1641, 1740, 1741 and the piston approaches top dead center. The inlet valve opens near top dead center at points 1643, 1642, 1743, 1742. Pressure reaches its maximum, shortly after at point 1645, 1651 with the magnitude of maximum pressure dependent on the timing of the closure of the exhaust valve. The expansion ratio, and thus the work performed, can be controlled by modifying the timing of the closure the inlet valve at 1622, 1612, 1646, 1722, 1712, 1746 and can be seen particularly in the comparison of 1610 and 1620. The exhaust valve opens near bottom dead center at points 1647, 1648, 1649, 1747, 1748, 1749 and the cycle begins again at point 1650.

As with the compressor stages, the expander 116 may be cooled by a combination of conventional lubricant, ambient air flow and flows of coolant through the compressor structure. Preferably, the flows of coolant pass through a heat exchanger, 820 which may be conventionally made of metal, where they are cooled by the flow of ambient air or by other appropriate means. Cooling the expander does not increase efficiency but is necessary to maintain structural integrity and effective lubrication of piston rings, bearings, and other moving parts. This cooling keeps component temperatures at levels that assure adequate strength.

As noted in the discussions above, the expander module 150 may include a regenerator or recuperator 802, which may be a compact metal heat exchanger, that performs an exchange of heat between the low-pressure, high temperature exhaust from the outlet valve 817 of the expander 816 and the high pressure, moderate temperature air flow from the outlet valve 112 of the compressor module 100. The two flow streams do not mix, but exchange heat with a high effectiveness such that the air entering the expander at input valve 814 is very close to the temperature of the exhaust gas of the expander 816. The recuperator 802 is preferably insulated to minimize heat losses and thus increase the overall effectiveness of the system.

Further, pressure drops should be minimized for both flows to increase the efficiency of the recuperator 802. And, because the recuperator 802, like the intercoolers 105, 113 discussed above, is essentially a steady-flow device while the compressor 100 and expander 150 modules are intermittent flow devices, the recuperator 802 and the tubing at its input 814 and output 817 must have an air volume sufficient to prevent more than a negligible cyclic change in the air pressure in the recuperator 802. To further minimize pressure changes, the timing of the input and output valves of the system should be phased so the final air output of the compressor module 100 occurs at more or less the same time as the air intake of the expander module 150. Although, typically, the last compressor stage 111 and the expander 150 operate at the same RPM, being driven by a common crankshaft 199, the ideal phase timing relationship between the two modules may vary with increased or decreased RPM, thus requiring an optimization of the timing that takes the RPM into account. Frictional pressure drops in the recuperator are minimized by the effect of recuperator air volume on reducing flow transients and high peak flows exiting the compressor and entering the expander.

Expander and Compressor Inlet Valve Stem Seal

In the current invention, some of the poppet valve stems are continually exposed to the high compressed air pressure. This is a different situation from that of poppet valves used in other internal combustion engines where the valve stems are exposed to near-ambient pressure when closed. Even in supercharged or turbocharged engines, where the inlet and/or exhaust poppet valve stems are exposed to pressures substantially above ambient, pressures are not as high as those likely to be seen with the expander inlet valve or compressor outlet valves.

For example, with reference to FIG. 9, the expander inlet valve 914 is located in the expander cylinder head. As described above, its function is to open at or near piston top dead center position and permit high-pressure compressed air to enter the expander cylinder. The air entering the expander cylinder is mixed with fuel and combustion occurs within this cylinder substantially increasing the temperature of the air-fuel-combustion product mixture while remaining at approximately constant pressure because the air inlet valve is open during much of the combustion. Thus, the valve stem 950 is always exposed to high air pressure from the output of the compressor module 100.

In contrast, FIG. 10 shows an inlet valve design with the valve stem seal exposed to the expander cylinder pressure. This is a cyclic pressure varying from peak pressures that may be as high as about 3000 psi to exhaust pressures that may be near ambient.

Similar issues occur in the compressor inlet valve design shown in FIG. 5, where the inlet valve 550 stem seal may be exposed to high compressed air pressure from previous compressor stages. A first stage piston compressor may use poppet valves for inlet and outlet valves, and the outlet valve stem will see a continuous high pressure in this configuration. However, in second or subsequent stage piston compressor of the same design will see continuous high pressures at both the inlet and outlet valve 550, 560 stems.

Thus, preferably, the valve stem preferably must be sealed in order to prevent compressed air or combustion gas leakage out through the valve stem, which would lower engine efficiency. This is analogous to the sealing of the piston at the cylinder walls, shown in FIGS. 5 and 13, where piston rings 515, 1316 and lubricant prevent gas leakage past the piston.

With reference to FIG. 18, the valve 1800 includes a stem seal design that may use a stack of rings 1801 with a close fit to the valve stem 1803, with pressurized lubricant 1802 fed into this stack near the ambient pressure end. A wave spring 1805 may be employed for biasing and a retainer 1806 used to hold the spring and valve in place. The lubricant permits low-friction sliding of the valve stem 1803 within the ring stack, but also wets and coats all ring and valve stem surfaces with a moderate-viscosity liquid that prevents or minimizes air or gas leakage through this seal. The lubricant 1802 pressure and flow may need to increase as the air pressure in the duct 1810, and thus at the valve stem, increases.

Control of Power Output and Auxiliary Compressor Modules

There are four methods that may be used to control the engine's power output. The first is to vary the engine speed or RPM with the net work output per cycle remaining fixed.

Second, as described above in connection with the Compressor Module, it is possible to change the compressor inlet valve open time and expander input air mass flow rate and pressure and thereby change the net work output per cycle at a constant engine speed.

Third, as described above in connection with the Expander Module, it is possible to increase the power output by increasing the amount or volume of air entering the expander at a fixed inlet pressure and at a constant RPM by altering the timing of the inlet valve 814. The expansion ratio is determined by the inlet valve 814 closure, since the exhaust valve always opens at or near bottom dead center. By adjusting the inlet valve closure to occur at a different crank angle the work output can be changed, as shown with reference to the horizontal axis in FIG. 16. The first cycle 1610, with an expansion ratio of 10 has a greater expander work output than the second cycle 1620 with an expansion ratio of 20; the gas expansion from point 1622 providing less P-V area and thus less work than does expansion from point 1612.

The Auxiliary Compressor Module

With reference to FIG. 19, the fourth method of power output control utilizes an auxiliary compressor module 1900. The auxiliary compressor module is intended to compress air to high pressures and to store this compressed air in cylinders or tanks for future use. This use may be for those engine applications that benefit from energy storage or from rapid changes in engine power output, such as most vehicle applications. The use of a significant air accumulator at the interconnections, particularly the compressor module to expander module interconnection, will slow engine transient response. The auxiliary compressor module can make this transient response significantly faster. It uses one or more stages of piston-cylinder devices 1901 to compress air taken from a compressor stage output or from ambient air through controlled inlet valve 1905. This air is compressed to a high pressure, perhaps 2500 to 5000 psi. This compressed air is released through controlled outlet valve 1906 and stored in cylinders or tanks 1902. When needed, this air is fed back into the compressor outlet or expander module inlet at a controlled flow rate through a flow control valve 1910.

The auxiliary compressor may be shaft 199 driven from the modular engine expander power output shaft 194, or from the wheel drive shaft in a vehicular application, or by an electric motor that receives electrical energy from an electrical generator or alternator driven by the engine, or from some other source.

As with the compressor module, the auxiliary compressor may use an intercooler (not shown) before its air inlet 1905 to decrease the air temperature entering the compressor and thereby decrease the compressed air specific volume and compression work. It may also use a heat exchanger for compressor cooling.

The air into the auxiliary compressor may be at a continuous low flow rate until the capacity of the compressed air storage tanks is reached; then the auxiliary compressor stops taking in and compressing air by means obvious to those of ordinary skill in the art, such as keeping the auxiliary compressor inlet valves open, or using a clutch.

The air flow into the auxiliary compressor may increase whenever the compressor module output pressure decreases, such as a decrease in modular engine output torque as in an engine idle condition. This removal of air from the compressor module output by the auxiliary compressor more rapidly decreases the compressor module output pressure.

The auxiliary compressor may take power from the modular engine or from a vehicle driveshaft in order to assist in vehicle deceleration, capturing some of the energy from deceleration in the form of compressed air stored at high pressure in tanks. This form of regenerative braking can reduce overall modular engine fuel consumption by providing compressed air stored in tanks to supplement or replace air compressed by the compressor module.

The need for rapid increases in modular engine power output, as in vehicle acceleration, can be met by feeding compressed air from the compressed air storage tanks into the compressor output. This allows the compressor outlet air pressure to increase rapidly, which results in modular engine output torque increasing rapidly. This use of the compressed air from tanks decreases compressor power during engine acceleration (torque and power increases as, for example, in vehicle acceleration) and decreases overall modular engine fuel consumption, as described above.

Especially in the case of the unsteady or transient operation of the engine from high power levels (high RPM and high expander inlet pressures) to low power levels (low RPM and low expander inlet pressures) or from low to high power levels, the system benefits from the use of an auxiliary compressor module comprising an air compressor and compressed air storage.

With reference to FIGS. 1 and 8, when engine operation at increased power levels is needed, stored compressed air can be metered using an air flow control valve 1910 into the compressor module 100, specifically at the recuperator inlet 112 to augment or replace the compressed air flow exiting the last compressor stage 111. This air flow augmentation rapidly raises the air pressure in the recuperator 802 and consequently in the air entering the expander module 150. Such a rapid increase in pressure increases the power output rapidly. Without such air augmentation the transient response would depend solely upon the compressor air mass flow increasing, but this increase must occur slowly enough to allow expander power output to increase more rapidly than compressor power input. Since the volume of compressed air in the recuperator may be relatively large, the time to raise the pressure in the recuperator can be significant if this pressure increase is due only to increased compressor air mass flow. In that case, the compressor power input increases, but with a delayed increase in expander power output such that there could be a transient decrease in engine power output. Thus, while a slow rate of change or augmented air flow into the recuperator will permit increases in power output, air augmentation is likely to achieve much more rapid increases. The power input to the compressor stages can be controlled to increase, stay the same, or decrease, as air augmentation is used to increase the recuperator pressure which is also the last stage compressor outlet pressure. The inlet valve controls for the main compressor stages can be used to adjust compressed air mass flow rate. An appropriate decrease in mass flow rate can allow compressor input power to stay the same or decrease during air augmentation, while expander power output and system power output increase.

The decrease in the engine power output to lower levels of recuperator pressure requires utilization or dissipation of the energy stored in the compressed air in the recuperator. The auxiliary air compressor can remove air from the recuperator inlet and thereby decrease the pressure in the recuperator and expander inlet, reducing the system power level. This compressed air can then be stored in a tank for use during power increase transients.

The compressed air storage tank may have a pressure level of about 1.2 to 2.5 times that of the maximum compressor module output air pressure. This maximum pressure may be about 2000 psi with the compressed air storage tank then operating in the range of perhaps 2400 psi to 5000 psi.

The vehicular use of the engine can also achieve the recovery of some of the kinetic energy lost in braking by using the auxiliary compressor to consume more power during braking and to compress more air for future use. The auxiliary compressor uses inlet valve timing to control the mass of air compressed each cycle, in the same manner as the main compressor stages.

While the present invention has been shown and described with reference to the foregoing preferred embodiment, it will be apparent to those skilled in the art that other changes in form, connection, and detail may be made therein without departing from the spirit and scope of the invention as defined in the appended claims.

I claim:

1. An engine comprising:

an air compression module comprising at least two compressors, each having a compressor inlet and a compressor outlet, wherein at least one of the compressors comprises a first piston-cylinder device having a compressor inlet valve at the inlet and compressor outlet valve at the output; first means for conducting compressed air from the compressor outlet of the first compressor to the inlet of the second compressor; and second means for conducting compressed air from the outlet of the second compressor;

an expander module comprising a second piston-cylinder device having a variable volume, wherein the second piston-cylinder device comprises:

a cylinder defining a head, a piston having a face, wherein the piston is reciprocal within said cylinder from a top dead center position wherein the face is near the head and the volume of the second piston-cylinder device is minimized, to a bottom dead center position wherein the face is moved away from the head and the volume of the second piston-cylinder device is maximized;

a duct having a first opening at one end into said cylinder through the head and a second opening for receiving compressed air from the second compressor;

an expander inlet valve near the second opening of the duct for controlling the flow of compressed air into the duct which expander inlet valve is open when the piston is at the top dead center position and closes when the piston reaches a selected point between the top dead center position and the bottom dead center position;

an injector for injecting fuel into the duct wherein fuel and compressed air are mixed to form a mixture, igniting means for igniting the mixture when the piston is near the top dead center position whereby the mixture combusts and expands, driving the piston toward the bottom dead center position and forming heated exhaust gas;

and wherein the second piston cylinder device further comprises an expander outlet valve near the head for controlling the expulsion of heated exhaust gas, and wherein said outlet valve is open when the piston is at the bottom dead center position and is closed at a selected point as the piston moves toward the top dead center position allowing exhaust gas remaining in the cylinder to be recompressed; and wherein the engine further comprises means for conducting the exhaust gas from the expander outlet valve.

2. An engine as in claim 1, wherein the expander module further comprises a recuperator comprising a heat exchanger in heat exchanging relationship with the means for conducting the compressed air and the means for conducting the exhaust gas, whereby the compressed air is heated.

3. An engine as in claim 1, further comprising an intercooler for cooling the compressed air as such air is conducted from the outlet of one compressor to the inlet of the other compressor.

4. An engine as in claim 1 wherein the compressor module further comprises a cooling means for cooling the at least two compressors.

5. An engine as in claim 1 wherein the expander module further comprises a cooling means for cooling the head and the cylinder.

6. An engine as in claim 1 wherein at least one of the compressors is a bladed air compressor.

7. An engine as in claim 6 wherein the bladed air compressor is driven by a turbine powered by the exhaust gas.

8. An engine as in claim 1 wherein the injector sprays fuel in a plane substantially parallel to the piston face.

9. An engine as in claim 1 wherein the duct has a flattened center and flattened first opening and positioned such that the first opening is widest in a direction that is substantially parallel to the cylinder head.

10. An engine as in claim 9 wherein the injector sprays fuel in a plane substantially parallel to the cylinder head.

11. An engine as in claim 1 further comprising an auxiliary compressor including a compressing means and a reservoir for holding compressed air produced by the compressing means, a means for selectively controlling the release of the compressed air from the reservoir, a third conductor means for conducting the compressed air in the reservoir to the second opening of the duct.

12. An engine as in claim 1 wherein the expander inlet valve further comprises timing means that is adjustable during operation of the engine for controlling the opening and closing of the valve whereby the selected point may be changed during operation of the engine and wherein the timing means comprises a rotatable cam in operable connection with the expander inlet valve.

13. An engine as in claim 1 wherein the expander inlet valve further comprises timing means that is adjustable during operation of the engine for controlling the opening and closing of the valve whereby the selected point may be changed during operation of the engine and wherein the timing means comprises a three dimensional cam in operable connection with the expander inlet valve.

14. An engine as in claim 1 wherein the compressor inlet valve further comprises timing means that is adjustable during operation of the engine for controlling the opening and closing of the valve.

15. An engine as in claim 14 wherein the timing means comprises a rotatable cam in operable connection with the compressor inlet valve.

16. An engine as in claim 15 wherein the timing means comprises a three dimensional cam in operable connection with the compressor inlet valve.

17. An engine as in claim 1 wherein the compressed air and the fuel injected are controlled to maintain a constant fuel-air ratio.

18. An engine as in claim 1 wherein the exhaust gas remaining in the cylinder is recompressed to a pressure near that of the second compressor outlet when the expander piston reaches the top dead center position.

19. An engine comprising:

an air compression module comprising at least two compressors, each having a compressor inlet and a compressor outlet, wherein at least one of the compressors comprises a first piston-cylinder device having a compressor inlet valve at the inlet and compressor outlet valve at the output; first means for conducting compressed air from the compressor outlet of the first compressor to the inlet of the second compressor and an intercooler for cooling the compressed air as such air is conducted from the outlet of one compressor to the inlet of the other compressor, and second means for conducting compressed air from the outlet of the second compressor;

an expander module comprising a second piston-cylinder device having a variable volume, wherein the second piston-cylinder device comprises:

a cylinder defining a head, a piston having a face, wherein the piston is reciprocal within said cylinder from a top dead center position wherein the face is near the head and the volume of the second piston-cylinder device is minimized, to a bottom dead center position wherein the face is moved away from the head and the volume of the second piston-cylinder device is maximized;

a duct having a first opening at one end into said cylinder through the head and a second opening for receiving compressed air from the second compressor;

an expander inlet valve near the second opening of the duct for controlling the flow of compressed air into the duct which expander inlet valve is open when the piston is at the top dead center position and closes when the piston reaches a selected point between the top dead center position and the bottom dead center position;

an injector for injecting fuel into the duct wherein fuel and compressed air are mixed to form a mixture, igniting means for igniting the mixture when the piston is near the top dead center position whereby the mixture combusts and expands, driving the piston toward the bottom dead center position and forming heated exhaust gas;

and wherein the second piston cylinder device further comprises an expander outlet valve near the head for controlling the expulsion of heated exhaust gas, and wherein said outlet valve is open when the piston is at the bottom dead center position and is closed at a selected point as the piston moves toward the top dead center position allowing exhaust gas remaining in the cylinder to be recompressed to a pressure near that of the second compressor outlet when the expander piston reaches the top dead center position:

wherein the engine further comprises means for conducting the exhaust gas from the expander outlet valve, and further comprises a recuperator comprising a heat exchanger in heat exchanging relationship with the means for conducting the compressed air and the means for conducting the exhaust gas, whereby the compressed air is heated.

20. An engine as in claim 19 further comprising an auxiliary compressor including a compressing means and a reservoir for holding compressed air produced by the compressing means, a means for selectively controlling the release of the compressed air from the reservoir, a third-conductor means for conducting the compressed air in the reservoir to the second opening of the duct.

* * * * *